US008811865B2

(12) United States Patent
Inoue et al.

(10) Patent No.: US 8,811,865 B2
(45) Date of Patent: Aug. 19, 2014

(54) IMAGE FORMING APPARATUS

(75) Inventors: Tetsuhiro Inoue, Kanagawa (JP); Kousuke Kubota, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 373 days.

(21) Appl. No.: 13/368,929

(22) Filed: Feb. 8, 2012

(65) Prior Publication Data

US 2013/0078010 A1 Mar. 28, 2013

(30) Foreign Application Priority Data

Sep. 26, 2011 (JP) ..... 2011-209019

(51) Int. Cl.
*G03G 15/01* (2006.01)

(52) U.S. Cl.
CPC ..... *G03G 15/0178* (2013.01)
USPC ..... 399/301

(58) Field of Classification Search
CPC ..... G03G 15/0178
USPC ..... 399/301, 49, 72
See application file for complete search history.

(56) References Cited

U.S. PATENT DOCUMENTS

2003/0214568 A1* 11/2003 Nishikawa et al. ..... 347/116
2006/0182472 A1* 8/2006 Munakata et al. ..... 399/299
2010/0080603 A1 4/2010 Takahashi
2012/0045234 A1* 2/2012 Suzuki et al. ..... 399/49

FOREIGN PATENT DOCUMENTS

JP 4497223 B2 7/2010

* cited by examiner

*Primary Examiner* — Walter L Lindsay, Jr.
*Assistant Examiner* — Rodney Bonnette
(74) *Attorney, Agent, or Firm* — Sughrue Mion, PLLC

(57) ABSTRACT

An image forming apparatus includes an adjustment sequence controller that causes first to third adjustment processes to be executed. In the first adjustment process, if a second registration mark having reduced calculation errors of shifts of toner-image formation positions as compared with those of a first registration mark is formed in a normal way, the toner-image formation positions are adjusted by using the second registration mark. In the second adjustment process, if the second registration mark is not formed in the normal way, the toner-image formation positions are adjusted by using the first registration mark. In the third adjustment process, if the second registration mark is formed in the normal way after the second adjustment process, the toner-image formation positions are adjusted by using the second registration mark.

5 Claims, 12 Drawing Sheets

IMAGE FORMING APPARATUS

CROSS-REFERENCE TO RELATED APPLICATIONS

This application is based on and claims priority under 35 USC 119 from Japanese Patent Application No. 2011-209019 filed Sep. 26, 2011.

BACKGROUND (i) Technical Field

The present invention relates to an image forming apparatus that obtains a color toner image by overlaying toner images of plural colors on each other.

(ii) Related Art

There is known an image forming apparatus that obtains a color toner image by overlaying toner images of plural colors on each other. In many cases, such an image forming apparatus adjusts toner-image formation positions of toner-image forming units that form toner images of respective colors in order to overlay the toner images with high accuracy. When shifts of the current toner-image formation positions are detected for the adjustment, a method using a registration mark including a set of toner patterns formed by the toner-image forming units of the respective colors is frequently employed. With this method, the shifts of the toner-image formation positions are obtained by detecting the position of the registration mark formed on a transferred member such as an intermediate transfer belt and calculating the shifts based on the detection result.

SUMMARY

According to an aspect of the invention, there is provided an image forming apparatus including plural toner-image forming units that respectively use toners of plural colors and form plural toner images of different colors; a transferred member that moves along the plural toner-image forming units and receives transfer of the plural toner images formed by the plural toner-image forming units; a transfer member that further transfers the toner images of the plural colors transferred on the transferred member, on a recording medium; a fixing unit that fixes the toner images of the plural colors transferred on the recording medium, to the recording medium; a mark formation controller that causes the plural toner-image forming units to form a registration mark including a set of toner patterns for detection of shifts of toner-image formation positions of the plural toner-image forming units, on the transferred member; a mark sensor that detects positions of the toner patterns included in the registration mark formed on the transferred member; a formation-position shift calculator that calculates the shifts of the toner-image formation positions of the plural toner-image forming units based on the detection result of the mark sensor; a mark judging unit that judges whether or not the registration mark detected by the mark sensor is a normal mark having accuracy enough for the calculation of the shifts of the toner-image formation positions of the plural toner-image forming units, based on the detection result of the mark sensor; a formation-position adjuster that adjusts the toner-image formation positions of the plural toner-image forming units based on the calculation result of the formation-position shift calculator; and an adjustment sequence controller. The adjustment sequence controller causes a first adjustment process to be executed by forming a second registration mark from among a first registration mark and the second registration mark, judging whether or not the second registration mark is a normal mark based on the detection result for the second registration mark, calculating the shifts of the toner-image formation positions based on the detection result for the second registration mark if it is judged that the second registration mark is the normal mark, and adjusting the toner-image formation positions based on the calculation result, the first registration mark including a set of first toner patterns, the second registration mark including a set of toner patterns having a second toner pattern, the second toner pattern being a toner pattern for detection of a shift of a toner-image formation position of at least one toner-image forming unit, the second toner pattern being formed by combining a first toner used by the at least one toner-image forming unit and a second toner used by another toner-image forming unit other than the at least one toner-image forming unit to reduce a calculation error of the shifts of the toner-image formation positions with the second toner pattern as compared with a calculation error with the first toner patterns. The adjustment sequence controller causes a second adjustment process to be executed by forming the first registration mark if it is judged that the second registration mark is not the normal mark, judging whether or not the first registration mark is a normal mark based on the detection result for the first registration mark, calculating the shifts of the toner-image formation positions based on the detection result for the first registration mark if it is judged that the first registration mark is the normal mark, and adjusting the toner-image formation positions based on the calculation result. Then the adjustment sequence controller causes a third adjustment process to be executed by forming the second registration mark, judging whether or not the second registration mark is the normal mark based on the detection result for the second registration mark, calculating the shifts of the toner-image formation positions based on the detection result for the second registration mark if it is judged that the second registration mark is the normal mark, and adjusting the toner-image formation positions based on the calculation result.

BRIEF DESCRIPTION OF THE DRAWINGS

Exemplary embodiment(s) of the present invention will be described in detail based on the following figures, wherein.

DETAILED DESCRIPTION

An image forming apparatus according to specific exemplary embodiments of the invention will be described below with reference to the figures.

First, a first exemplary embodiment is described.

Figure 1:
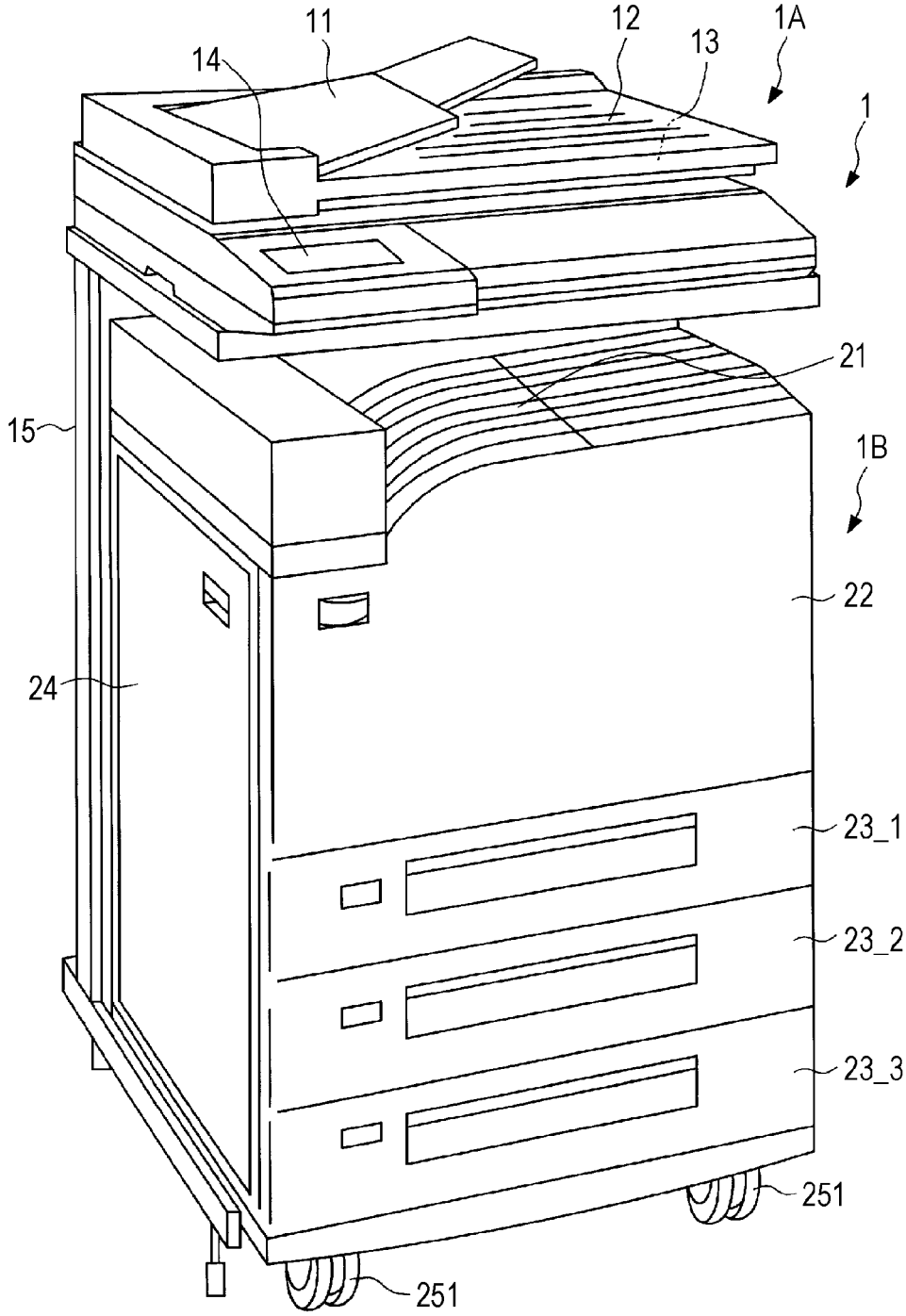
FIG. 1 is an external perspective view of a copier which is an image forming apparatus according to an exemplary embodiment of the present invention.

FIG. 1 is an external perspective view of a copier which is an image forming apparatus according to an exemplary embodiment of the present invention;

A copier 1 includes a document reading section 1A and an image forming section 1B.

The document reading section 1A includes a document feed tray 11 on which documents are placed in a stacked manner. The documents placed on the document feed tray 11 are fed one by one, a character or an image recorded on the documents is read, and then the documents are output onto a document output tray 12.

The document reading section 1A has a horizontally extending hinge at a far side. The document feed tray 11 and the document output tray 12 may be lifted together around the hinge. A document reading plate 13 (see FIG. 2) made of transparent glass is spread below the document feed tray 11 and the document output tray 12. A reading method with the document reading section 1A includes a method of placing a single document on the document reading plate 13 with a surface to be copied facing downward, instead of placing a document on the document feed tray 11, and reading a character or an image from the document on the document reading plate 13.

A display operation unit 14 is provided at a front side of the document reading plate 13. The display operation unit 14 displays various messages for a user and displays various operation buttons to receive an operation such as an instruction for image reading and an instruction for image formation from the user.

The document reading section 1A is entirely supported by a support frame 15.

The image forming section 1B includes a sheet output tray 21. A sheet with an image formed on an upper surface of the sheet is output onto the sheet output tray 21. A front cover 22 is provided at a front surface of the image forming section 1B. The front cover 22 is opened when a part such as a toner container is replaced or when a paper jam occurring during transportation is cleared. Also, three drawer-type sheet feed trays 23_1, 23_2, and 23_3 are housed below the front cover 22. Sheets before image formation are housed in the sheet feed trays 23_1, 23_2, and 23_3 in a stacked manner.

A side cover 24 is provided at a left surface of the image forming section 1B. The side cover 24 is opened when a paper jam occurring during transportation is cleared.

Further, wheels 251 that move the image forming section 1B are attached to a bottom surface of the image forming section 1B.

Figure 2:
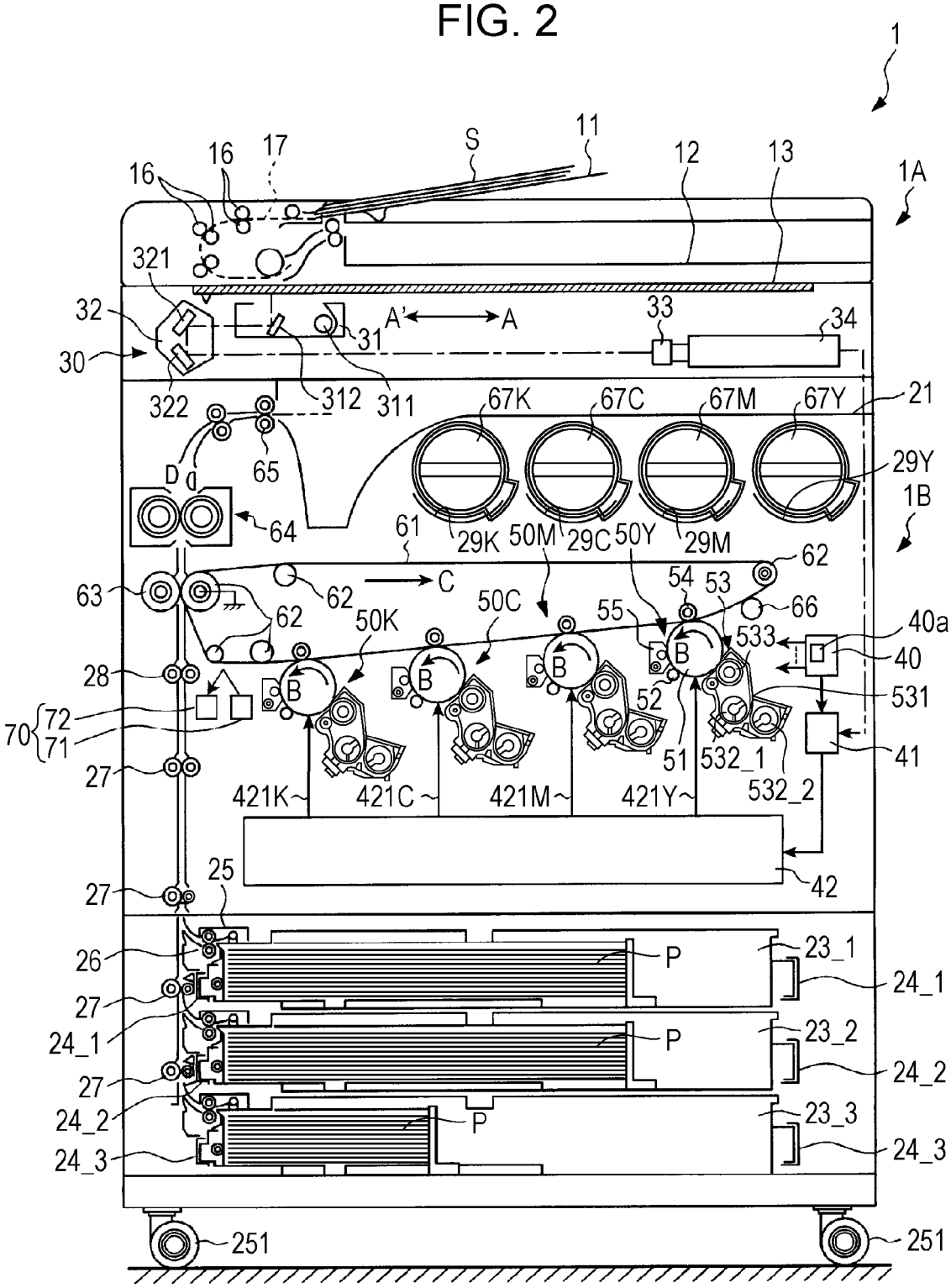
FIG. 2 is an interior configuration diagram of the copier the exterior of which is shown in FIG. 1.

FIG. 2 is an interior configuration diagram of the copier the exterior of which is shown in FIG. 1;

A document reading optical system 30 is arranged below the document reading plate 13 made of transparent glass. The document reading optical system 30 includes a first block 31, a second block 32, and a photoelectric sensor 33. The first block 31 has a lamp 311 and a mirror 312. The second block 32 includes two mirrors 321 and 322. The photoelectric sensor 33 reads light representing an image and generates an image signal.

The first block 31 and the second block 32 are mounted to the document reading section 1A movably in directions indicated by arrows A-A' along the document reading plate 13. In an initial state, the first block 31 and the second block 32 are located at a left position shown in FIG. 2.

Documents S placed on the document feed tray 11 are fed one by one and transported in a transport path 17 that is in contact with the document reading plate 13 by transport rollers 16. The lamp 311 radiates each document S with light when the document S is transported while being in contact with the document reading plate 13. Reflected light from the document S is reflected by the mirrors 312, 321, and 322. The photoelectric sensor 33 reads the reflected light. The photoelectric sensor 33 generates an image signal representing a character or an image recorded on the document S. The document S after radiation by the lamp 311 is further transported onto the document output tray 12.

When a document is placed on the document reading plate 13, the first block 31 and the second block 32 move in the direction indicated by the arrow A such that the optical distance between a reading position of the document on the document reading plate 13 and the photoelectric sensor 33 is kept constant. During the movement, the lamp 311 radiates the document with light, and the photoelectric sensor 33 reads a character or an image on the document and converts the character or the image into image signals.

The image signals acquired by the photoelectric sensor 33 are input to an image processor 34. The image signals acquired by the photoelectric sensor 33 are image signals representing respective colors including red (R), green (G), and blue (B). The image processor 34 converts the RGB image signals into image data of four colors including yellow (Y), magenta (M), cyan (C), and black (K), and temporarily stores the image data. The YMCK image data is transmitted to an exposure controller 41 at a timing of exposure for formation of a latent image (described later).

The image forming section 1B includes an exposure unit 42. When a latent image is formed, the image data of YMCK is transmitted from the exposure controller 41 to the exposure unit 42. The exposure unit 42 emits exposure light beams 421Y, 421M, 421C, and 421K that are modulated respectively in accordance with the image data of YMCK.

Also, referring to FIG. 2, a main controller 40 is arranged at a position next to the exposure controller 41. The main controller 40 includes a microcomputer and a program executed by the microcomputer. The main controller 40 is connected with the exposure controller 41, the display operation unit 14 (see FIG. 1), the image processor 34, and other power supply circuit and driving circuit (not shown), and provides control for the entire copier 1. The main controller 40 also includes a memory 40*a* that stores the above-described program and various parameters etc. used for execution of the program.

The above-described three sheet feed trays 23_1, 23_2, and 23_3 are housed in a lower portion of the image forming section 1B and supported by left and right guide rails 24_1, 24_2, and 24_3. Sheets P are housed in a stacked manner in each of the sheet feed trays 23_1, 23_2, and 23_3. The sheet feed trays 23_1, 23_2, and 23_3 may be pulled out while being guided by the guide rails 24_1, 24_2, and 24_3 for supply of sheets P.

Sheets P are fed by a pickup roller 25 from a sheet feed tray designated by an operation or the like of the display operation unit 14 (see FIG. 1) from among the three sheet feed trays 23_1, 23_2, and 23_3 (in this case, for example, sheets P are fed from the sheet feed tray 23_1). The sheets P are separated one by one by separation rollers 26 and the separated single sheet P is transported upward by a transport roller 27. A holding roller 28 adjusts the timing of transportation of the sheet P in a path arranged downstream of the holding roller 28. Then, the sheet P is further transported upward. The transportation of the sheet P in the path arranged downstream of the holding roller 28 will be described later.

Four image forming units 50Y, 50M, 50C, and 50K that form toner images with toners of the respective colors of YMCK are arranged in a center portion of the image forming section 1B in that order from the right side in the figure. The four image forming units 50Y, 50M, 50C, and 50K correspond to examples of plural toner-image forming units.

The four image forming units 50Y, 50M, 50C, and 50K have equivalent configurations except that the colors of the toners to be used differ from each other. Hence, the configuration of the Y-color image forming unit 50Y is representatively described here.

The image forming unit 50Y includes a photoconductor 51 that rotates in a direction indicated by an arrow B in FIG. 2. A charging device 52, a developing device 53, and a cleaner 55 are arranged around the photoconductor 51. Also, a transfer member 54 is arranged at a position at which an intermediate transfer belt 61 (described later) is arranged between the transfer member 54 and the photoconductor 51.

The photoconductor 51 has a roller-like shape, holds an electric charge by charging, emits the electric charge by exposure, and holds an electrostatic latent image on a surface of the photoconductor 51.

The charging device 52 charges the surface of the photoconductor 51 with electricity with a certain charge potential.

The image forming section 1B also includes the exposure unit 42 described above. The exposure unit 42 receives the image signals input from the exposure controller 41, and outputs the exposure light beams 421Y, 421M, 421C, and 421K that are modulated in accordance with the input image signals. The photoconductor 51 is charged with electricity by the charging device 52, and then is radiated with the exposure light beam 421Y from the exposure unit 42. Thus, an electrostatic latent image is formed on the surface of the photoconductor 51.

After the electrostatic latent image is formed on the surface of the photoconductor 51 as the result of the radiation with the exposure light beam 421Y, the electrostatic latent image is developed by the developing device 53, and a toner image (in this image forming unit 50Y, a toner image with a toner of yellow (Y)) is formed on the surface of the photoconductor 51.

The developing device 53 includes a case 531 that contains a developer formed of a toner and a carrier therein, two augers 532_1 and 532_2 that stir the developer, and a developing roller 533 that conveys the developer to a position at which the developing roller 533 faces the photoconductor 51. The augers 532_1 and 532_2 and the developing roller 533 are arranged in the case 531. When the electrostatic latent image formed on the photoconductor 51 is developed, a bias voltage is applied to the developing roller 533. The toner in the developer adheres to the electrostatic latent image formed on the photoconductor 51 by the action of the bias voltage, and thus a toner image is formed.

The toner image formed on the photoconductor 51 through the development by the developing device 53 is transferred onto the intermediate transfer belt 61 by the action of the transfer member 54.

The cleaner 55 removes the toner remaining on the photoconductor 51 after the transfer.

The intermediate transfer belt 61 is an endless belt wound around plural rollers 62. The intermediate transfer belt 61 circulates in a direction indicated by an arrow C along the arrangement of the four image forming units 50Y, 50M, 50C, and 50K. The intermediate transfer belt 61 corresponds to an example of a transferred member.

Toner images with toners of the respective colors formed on the image forming units 50Y, 50M, 50C, and 50K are transferred onto the intermediate transfer belt 61 such that the toner images are successively overlaid on each other in order of Y, M, C, and K, and are transported to a second transfer position at which a transfer member 63 is arranged. In synchronization with this, the sheet P transported to the holding roller 28 is transported to the second transfer position. By the action of the transfer member 63, the toner image on the intermediate transfer belt 61 is transferred onto the transported sheet P. The sheet P with the toner image transferred is further transported, and the toner image on the sheet P is fixed to the sheet P by pressure and heat of a fixing device 64. The sheet P having an image formed of the fixed toner image thereon is further transported and output onto the sheet output tray 21 by an output roller 65. The transfer member 63 corresponds to an example of a transfer unit. The fixing device 64 corresponds to an example of a fixing unit.

The intermediate transfer belt 61 after the toner image is transferred onto the sheet P by the transfer member 63 further circulates. A cleaner 66 removes the toner remaining on the surface of the intermediate transfer belt 61.

Also, container mount portions 29Y, 29M, 29C, and 29K are provided above the intermediate transfer belt 61 in the image forming section 1B. Toner containers 67Y, 67M, 67C, and 67K that contain the toners of YMCK colors are mounted on these container mount portions 29Y, 29M, 29C, and 29K. The toners of the respective colors contained in the toner containers 67Y, 67M, 67C, and 67K are supplied to the developing devices 53 in accordance with toner consumption of the developing devices 53.

In the image forming section 1B, the transfer positions of the toner images of the respective colors may be shifted on the intermediate transfer belt 61, because of, for example, vibration or a change in temperature during an operation, or a shift of a mount position of the image forming unit when the image forming unit is replaced.

Owing to this, in the image forming section 1B, the main controller 40 executes registration processing as follows.

The registration processing is processing of adjusting formation positions of electrostatic latent images on the photoconductors 51 of the image forming units by adjusting timings of radiation with exposure light beams to the photoconductors 51 based on the image data input to the exposure controller 41. Positions of toner images on the intermediate transfer belt 61 are positions corresponding to formation positions of electrostatic latent images on the photoconductors 51. Hereinafter, formation positions of electrostatic latent images on the photoconductors 51 are referred to as toner-image formation positions. By the registration processing, the toner-image formation positions are adjusted only by positional shifts of the toner images of the respective colors. The function of executing this registration processing by the main controller 40 corresponds to an example of a formation-position adjuster.

The registration processing uses adjustment values for adjusting timings of radiation with exposure light beams. The adjustment values are generated when various phenomena occur, such as when image formation is performed for a predetermined number of sheets, when a temperature-humidity environment is changed, and when a part is replaced. To generate the adjustment values, a registration mark is used. The registration mark includes toner patterns for YMCK colors having predetermined shapes. When the adjustment values are generated, the registration mark is transferred onto the intermediate transfer belt 61. The toner patterns included in the registration mark are photoelectrically detected. Based on the detection result, shifts of the current toner-image formation positions among the image forming units 50Y, 50M, 50C, and 50K of the respective colors are calculated. Further, adjustment values for adjusting toner-image formation positions by an amount corresponding to the calculation result are generated.

In the image forming section 1B, an optical sensor 70 is arranged. The optical sensor 70 radiates a position located downstream of the K-color image forming unit 50K and upstream of the transfer member 63 in a moving direction of the intermediate transfer belt 61 with light, receives reflected light, and outputs a signal corresponding to the intensity of the reflected light. The optical sensor 70 includes a light emitting portion 71 that emits light with a wavelength of 940 nm and a light receiving portion 72 that receives reflected light. The light receiving portion 72 is arranged at a position where the light receiving portion 72 receives light emitted from the light emitting portion 71 and reflected by specular reflection from the intermediate transfer belt 61. An output signal of the optical sensor 70 is transmitted to the main controller 40. In the first exemplary embodiment, the optical sensor 70 photoelectrically detects the positions of the toner patterns included in the registration mark formed on the intermediate transfer belt 61. The optical sensor 70 corresponds to an example of a mark sensor.

The main controller 40 measures relative positions of the toner patterns, calculates positional shift amounts of current toner-image formation positions of respective colors, and generates adjustment values, based on signals output from the optical sensor 70 when the toner patterns are detected. The function of the main controller 40 for calculating the positional shift amounts of the toner-image formation positions corresponds to an example of a formation-position shift calculator.

If a phenomenon that requires generation of the adjustment values used for the registration processing occurs, execution of generation of adjustment values has to be occasionally held at this timing, for example, during execution of a print operation. Owing to this, in the first exemplary embodiment, if a phenomenon that requires generation of adjustment values occurs, an adjustment-value generation request flag is set. Then, the flag is referenced at a timing at which processing such as a print operation is ended. When the flag is set, the main controller 40 causes the image forming units 50Y, 50M, 50C, and 50K of YMCK colors to generate the registration mark and to transfer the registration mark on the intermediate transfer belt 61. The main controller 40 also corresponds to an example of a mark formation controller.

After the formation of the registration mark, the optical sensor 70 receives the reflected light and the main controller 40 generates the adjustment values.

The generated adjustment values are stored on the memory 40*a* included in the main controller 40. The adjustment values are used for the registration processing when images are formed, until next new adjustment values are generated.

In the first exemplary embodiment, two types of registration marks described below are formed in processing described in a flowchart (described later) for generating adjustment values used for the registration processing.

Figure 3A:
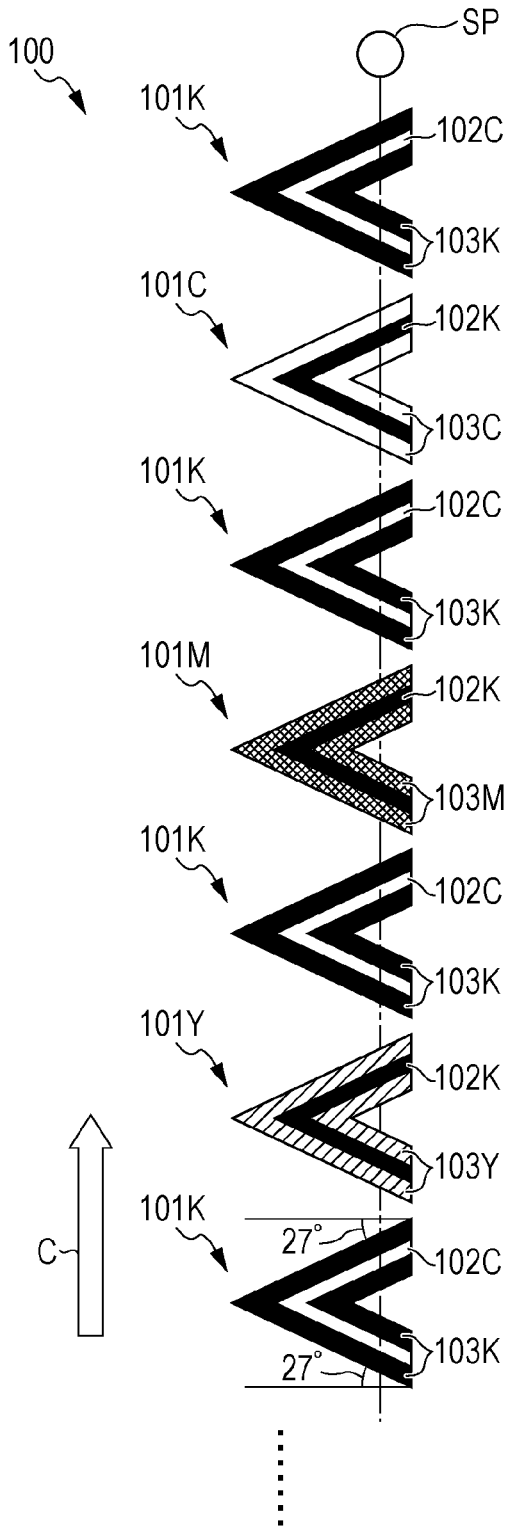
FIGS. 3A and 3B are illustrations showing two types of registration marks.
Figure 3B:
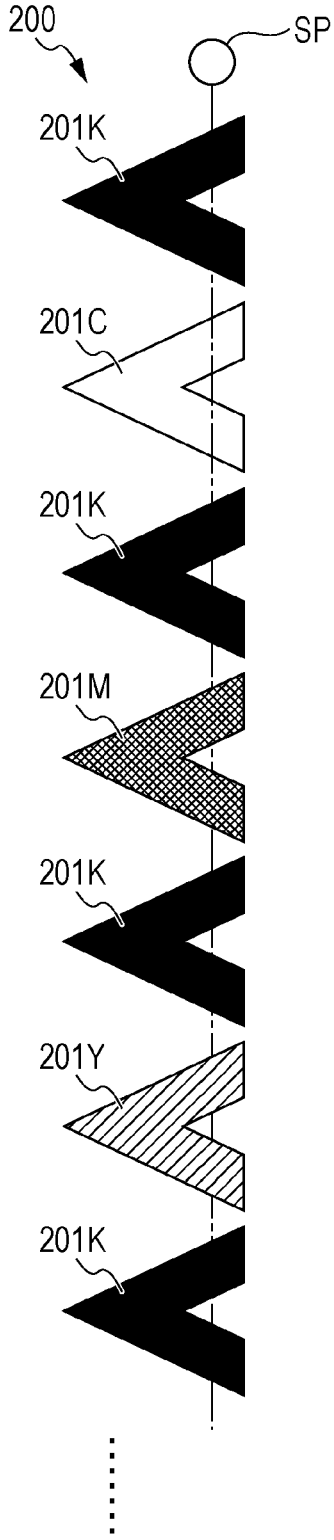

FIGS. 3A and 3B are illustrations showing the two types of registration marks.

FIG. 3A illustrates a multi-color registration mark 100 in which each toner pattern is formed with a combination of toners of two colors. FIG. 3B illustrates a single-color registration mark 200 in which each toner pattern is formed with a toner of a single color.

In the first exemplary embodiment, when the adjustment values for the registration processing are generated, the multi-color registration mark 100 in FIG. 3A and the single-color registration mark 200 in FIG. 3B are used. A method of generating the adjustment values according to the first exemplary embodiment will be described later in detail.

The registration mark 100 in FIG. 3A includes toner patterns 101Y, 101M, 101C, and 101K for YMCK colors.

The Y-color toner pattern 101Y is a toner pattern for detecting a positional shift of a toner-image formation position of the Y-color image forming unit 50Y shown in FIG. 2 with respect to a toner-image formation position of the K-color image forming unit 50K. The M-color toner pattern 101M is a toner pattern for detecting a positional shift of a toner-image formation position of the M-color image forming unit 50M with respect to the toner-image formation position of the K-color image forming unit 50K. The C-color toner pattern 101C is a toner pattern for detecting a positional shift of a toner-image formation position of the C-color image forming unit 50C with respect to the toner-image formation position of the K-color image forming unit 50K. Also, the K-color toner pattern 101K is a toner pattern for providing a toner-image formation position of the K-color image forming unit 50K as a reference position.

The toner patterns 101Y, 101M, 101C, and 101K for YMCK colors have equivalent shapes. In particular, the toner patterns each have a shape in which an arm inclined downward to the right and an arm inclined upward to the right are connected with each other at the left in the figure in a form of a protruding arrowhead.

Also, the toner patterns 101Y, 101M, 101C, and 101K for YMCK colors of the multi-color registration mark 100 each have the following pattern structure.

Figure 4:
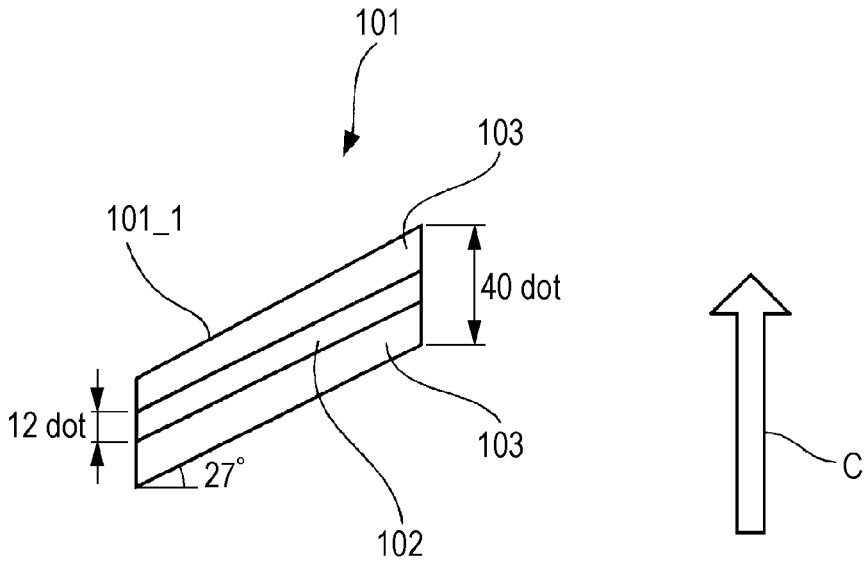
FIG. 4 is an illustration showing a pattern structure of a toner pattern included in a multi-color registration mark shown in FIG. 3A.

FIG. 4 is an illustration showing a pattern structure of a toner pattern included in the multi-color registration mark shown in FIG. 3A.

FIG. 4 schematically illustrates an arm 101_1 from among two arms of a toner pattern 101 included in the multi-color registration mark 100 having the arrowhead-like shape.

The toner patterns for YMCK colors included in the multi-color registration mark 100 have equivalent pattern structures. FIG. 4 illustrates the toner pattern 101 without distinction of colors.

As shown in FIG. 4, the arm 101_1 is inclined by 27° with respect to a left-right direction in the figure so as to be orthogonal to the moving direction of the intermediate transfer belt 61 indicated by an arrow C also shown in FIG. 2. The arm 101_1 has a width of 40 dots (1 dot=42 μm) in the moving direction.

The toner pattern 101 including the arm 101_1 has an inner pattern 102 with a width of 12 dots at an upper surface of the toner pattern 101 in the moving direction of the intermediate transfer belt 61. The toner pattern 101 also has outer patterns 103. The outer patterns 103 are designed to be arranged on both sides of the inner pattern 102 in the moving direction of the intermediate transfer belt 61 (see FIG. 2) indicated by the arrow C without a gap with respect to the inner pattern 102.

Referring back to FIG. 3A, the multi-color registration mark 100 is described.

The toner patterns 101Y, 101M, and 101C for three YMC colors of the multi-color registration mark 100 shown in FIG. 3A are arranged in line from the downstream side to the upstream side in order of YMC in the moving direction of the intermediate transfer belt 61 indicated by the arrow C. The K-color toner patterns 101K and the toner patterns 101Y, 101M, and 101C for YMC colors are alternately arranged. Consequently, the K-color toner patterns 101K are arranged on both sides of each of the toner patterns 101Y, 101M, and 101C for YMC colors in the moving direction indicated by the arrow C.

In FIG. 3A, for simplifying the illustration, the single toner pattern 101Y, the single toner pattern 101M, and the single toner pattern 101C for YMC colors are illustrated. The registration mark 100 according to the first exemplary embodiment includes plural toner patterns 101Y, plural toner patterns 101M, and plural toner patterns 101C for YMC colors. Each Y-color toner pattern 101Y is arranged between the K-color toner patterns 101K. Also, each M-color toner pattern 101M is arranged between the K-color toner patterns 101K. Further, each C-color toner pattern 101C is arranged between the K-color toner patterns 101K.

The K-color toner pattern 101K includes an inner pattern 102C formed with the C-color toner and outer patterns 103K formed with the K-color toner.

That is, the K-color toner pattern 101K is formed with a combination of the K-color toner used by the K-color image forming unit 50K and the C-color toner used by the C-color image forming unit 50C that differs from the K-color image forming unit 50K.

The C-color inner pattern 102C is designed such that the C-color toner is distributed without a gap in the moving direction indicated by the arrow C. The K-color outer patterns 103K are designed to be arranged on both sides of the C-color inner pattern 102C without a gap with respect to the C-color inner pattern 102C in the moving direction indicated by the arrow C.

Also, the Y-color toner pattern 101Y includes an inner pattern 102K formed with the K-color toner and an outer pattern 103Y formed with the Y-color toner.

The Y-color toner pattern 101Y is formed with a combination of the Y-color toner used by the Y-color image forming unit 50Y and the K-color toner used by the K-color image forming unit 50K that differs from the Y-color image forming unit 50Y.

The K-color inner pattern 102K is designed such that the K-color toner is distributed without a gap in the moving direction indicated by the arrow C. The Y-color outer pattern 103Y is designed to be arranged on both sides of the K-color inner pattern 102K without a gap with respect to the K-color inner pattern 102K in the moving direction indicated by the arrow C.

Also, the M-color toner pattern 101M includes the inner pattern 102K formed with the K-color toner and an outer pattern 103M formed with the M-color toner.

The M-color toner pattern 101M is formed with a combination of the M-color toner used by the M-color image forming unit 50M and the K-color toner used by the K-color image forming unit 50K that differs from the M-color image forming unit 50M.

The M-color outer pattern 103M is designed to be arranged on both sides of the K-color inner pattern 102K without a gap with respect to the K-color inner pattern 102K in the moving direction indicated by the arrow C.

Also, the C-color toner pattern 101C includes the inner pattern 102K formed with the K-color toner and an outer pattern 103C formed with the C-color toner.

The C-color toner pattern 101C is formed with a combination of the C-color toner used by the C-color image forming unit 50M and the K-color toner used by the K-color image forming unit 50K that differs from the C-color image forming unit 50C.

The C-color outer pattern 103C is designed to be arranged on both sides of the K-color inner pattern 102K without a gap with respect to the K-color inner pattern 102K in the moving direction indicated by the arrow C.

In the first exemplary embodiment, all the toner patterns 101Y, 101M, 101C, and 101K for YMCK colors included in the multi-color registration mark 100 have the inner patterns. Alternatively, the multi-color registration mark is not limited thereto. Only the K-color toner pattern may have the inner pattern, and the toner patterns for the other YMC colors may be respectively formed with only the toners for YMC colors.

Also, in the first exemplary embodiment, the K-color toner pattern 101K of the multi-color registration mark 100 has the C-color inner pattern 102C. Alternatively, the K-color toner pattern may have the Y-color inner pattern. Still alternatively, the K-color toner pattern may have the M-color inner pattern.

The single-color registration mark 200 in FIG. 3B includes toner patterns 201Y, 201M, 201C, and 201K for YMCK colors.

The outlines of the toner patterns 201Y, 201M, 201C, and 201K are the same as the outlines of the toner patterns 101Y, 101M, 101C, and 101K for the respective colors included in the above-described multi-color registration mark.

Also, the arrangement of the toner patterns 201Y, 201M, 201C, and 201K for the respective colors included in the single-color registration mark 200 is the same as the arrangement of the toner patterns 101Y, 101M, 101C, and 101K for the respective colors included in the above-described multi-color registration mark.

However, the toner patterns 201Y, 201M, 201C, and 201K for YMCK colors included in the single-color registration mark 200 are respectively formed with only the toners of YMCK colors.

In the first exemplary embodiment, in either of the multi-color registration mark 100 and the single-color registration mark 200, the toner patterns for YMC colors and the K-color toner patterns are alternately arranged. Alternatively, the registration mark may have an arrangement in which the toner patterns for YMCK colors are simply arranged in that order as a set and plural sets are arranged.

In the first exemplary embodiment, when the adjustment values required for the registration processing are generated, the two types of registration marks shown in FIGS. 3A and 3B are formed on the intermediate transfer belt 61 by processing described in the flowchart described later.

When the intermediate transfer belt 61 moves in the moving direction indicated by the arrow C, a spot SP of light emitted from the light emitting portion 71 of the optical sensor 70 shown in FIG. 2 passes across the toner patterns on the intermediate transfer belt 61. Then, the light receiving portion 72 receives reflected light reflected from the surface of the intermediate transfer belt 61 and the toner patterns.

In the first exemplary embodiment, a reflectance by specular reflection at the surface of the intermediate transfer belt 61 is higher than a reflectance by specular reflection at the toner image formed on the surface of the intermediate transfer belt 61. Hence, if the spot SP passes across the toner patterns, the intensity of reflected light received by the light receiving portion 72 decreases. In the first exemplary embodiment, the positions of the toner patterns included in the registration mark are detected by detecting a decrease in intensity of the reflected light. The adjustment values required for the registration processing are generated based on the detection result of the positions of the toner patterns.

A method of generating the adjustment values is common between the multi-color registration mark 100 shown in FIG. 3A and the single-color registration mark 200 shown in FIG. 3B. In the following description, the method of generating the adjustment values for the multi-color registration mark 100 shown in FIG. 3A is described as an example.

Figures 5A, 5B, 5C:
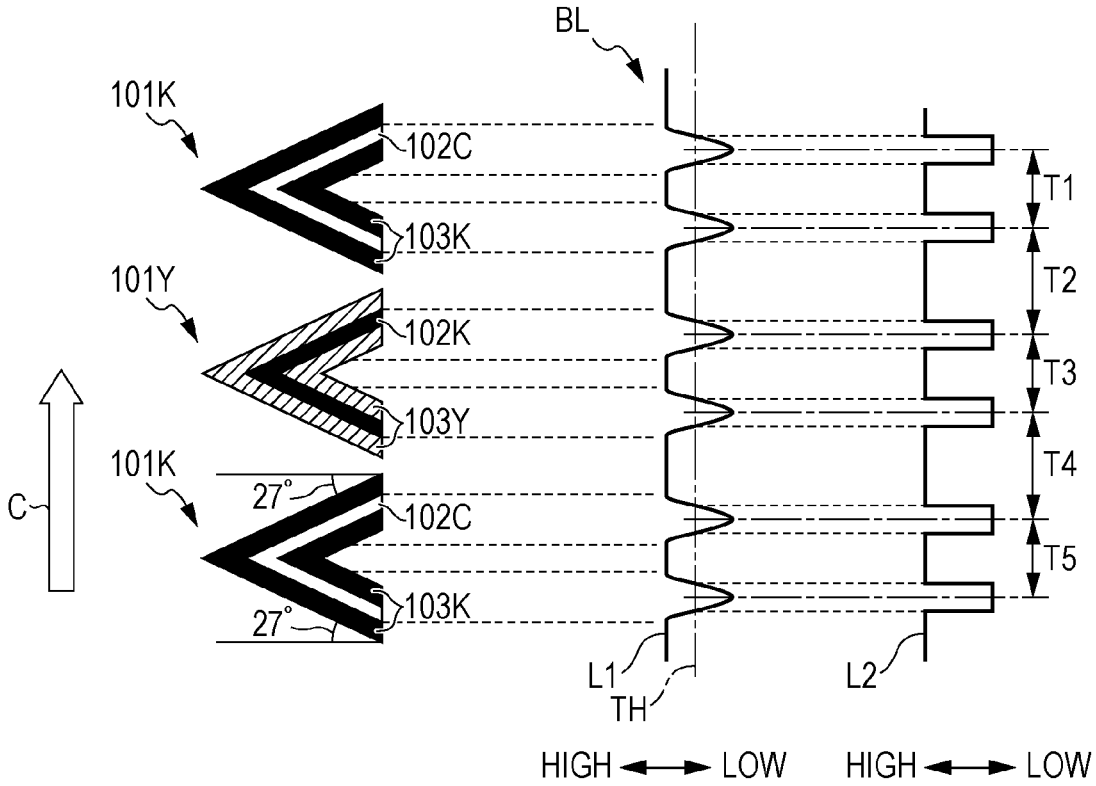
FIGS. 5A to 5C are illustrations showing an output signal of a light receiving portion of an optical sensor when the positions of toner patterns included in the registration mark are detected.

FIGS. 5A to 5C are illustrations showing an output signal of a light receiving portion of the optical sensor when the positions of the toner patterns included in the registration mark are detected.

FIG. 5A illustrates the multi-color registration mark 100.

The light receiving portion 72 shown in FIG. 2 outputs a signal representing a change in intensity level of received reflected light with respect to a moving distance of the spot SP on the intermediate transfer belt 61 since reception of the reflected light is started in response to an instruction from the main controller 40. FIG. 5B schematically illustrates a change in level of a signal output from the light receiving portion 72 as the result that the light receiving portion 72 receives the reflected light, in association with the shapes of the toner patterns, with respect to the moving distance of the spot SP in a form of a first line L1. In FIG. 5B, a signal level decreases toward the right in the figure. In this exemplary embodiment, the moving distance of the spot SP is handled by the unit of a dot (1 dot=42 μm).

As described above, each toner pattern has an arrowhead-like shape and has two arms such that an interval between the arms increases toward the right in the figure. As indicated by the first line L1, the signal level of the output signal of the light receiving portion 72 decreases when the spot SP passes through a position above each arm of the toner patterns.

Such an output signal is input to the main controller 40 shown in FIG. 2, and is binarized through comparison with the following threshold TH. In this exemplary embodiment, the threshold TH employs a middle level between a reference level BL corresponding to an intensity of reflected light at the surface of the intermediate transfer belt 61 and the bottom of the decrease at which the decrease is the largest.

By binarization, the output signal from the light receiving portion 72 is converted into a pulsed signal indicated by a second line L2 in FIG. 5C. In FIG. 5C, a signal level decreases toward the right in the figure. Each pulse appearing in the pulsed signal corresponds to each of the two arms of each toner pattern.

It is to be noted that origins for formation of toner images of the respective colors are present on the photoconductors 51 of the image forming units 50Y, 50M, 50C, and 50K of the respective colors.

Points, at which the origins on the photoconductors 51 of the image forming units 50Y, 50M, and 50C of YMC colors are mapped on the intermediate transfer belt 61, are ideally aligned with a point, at which the origin on the photoconductor 51 of the K-color image forming unit 50K is mapped on the intermediate transfer belt 61.

Hereinafter, the point, at which the origin on each photoconductor 51 is mapped on the intermediate transfer belt 61, is referred to as an origin of a toner-image formation position for each of the image forming units 50Y, 50M, 50C, and 50K of the respective colors. For example, if installation errors of the photoconductors 51 are present among the image forming units 50Y, 50M, 50C, and 50K of the respective colors, the origins, which should be aligned with each other, may be shifted from each other. Shifts of the origins cause positional shifts of toner-image formation positions among the image forming units 50Y, 50M, 50C, and 50K of the respective colors. Hereinafter the positional shift of the origin of a toner-image formation position is merely referred to as a positional shift of a toner-image formation position.

In the first exemplary embodiment, the main controller 40 calculates positional shift amounts of the toner-image formation positions of the image forming units 50Y, 50M, and 50C of YMC colors shown in FIG. 2, with reference to the origin of the toner-image formation position of the K-color image forming unit 50K, based on the above-mentioned pulsed signal.

In contrast, for the K-color image forming unit 50K, the origin of the toner-image formation position of the K-color image forming unit 50K serves as the reference for the positional shift. That is, it is assumed that the positional shift amount of the K-color image forming unit 50K is normally "0."

Then, the main controller 40 generates the adjustment values used for the registration processing, based on the positional shift amounts calculated for the image forming units 50Y, 50M, and 50C of YMC colors. In contrast, since it is assumed that the positional shift amount of the K-color image forming unit 50K is normally "0," the adjustment value is also normally "0."

In the first exemplary embodiment, the adjustment values are generated while the origin of the toner-image formation position of the K-color image forming unit 50K serves as the reference as described above. Alternatively, adjustment values may be generated while the origin of the toner-image formation position of the image forming unit of a color other than the K color serves as the reference. Still alternatively, reference positions may be provided by the design respectively for the image forming units 50Y, 50M, 50C, and 50K of YMCK colors. In this case, positional shift amounts of the origins of the toner-image formation positions of the image forming units 50Y, 50M, 50C, and 50K for YMCK colors from the reference positions are respectively calculated. Then, adjustment values are generated based on the positional shift amounts. Yet alternatively, the adjustment values may not be generated based on the positional shift amounts from the reference positions, and positional shift amounts of toner-image formation positions between neighbor image forming units may be calculated.

A method of generating an adjustment value according to the first exemplary embodiment is common among YMC colors. Hence, for example, generation of a Y-color adjustment value is described.

To generate the Y-color adjustment value, five pulse intervals are used as follows.

A first pulse interval T1 is a pulse interval between two pulses corresponding to the K-color toner pattern 101K arranged downstream of the Y-color toner pattern 101Y in the moving direction of the intermediate transfer belt 61 indicated by the arrow C.

A second pulse interval T2 is a pulse interval between a pulse corresponding to a downstream arm in the moving direction from among pulses corresponding to the Y-color toner pattern 101Y and a pulse corresponding to an upstream arm from among pulses corresponding to the K-color toner pattern 101K arranged downstream of the Y-color toner pattern 101Y.

A third pulse interval T3 is a pulse interval between the two pulses corresponding to the Y-color toner pattern 101Y.

A fourth pulse interval T4 is a pulse interval between a pulse corresponding to an upstream arm in the moving direction from among the pulses corresponding to the Y-color toner pattern 101Y and a pulse corresponding to a downstream arm from among pulses corresponding to the K-color toner pattern 101K arranged upstream of the Y-color toner pattern 101Y.

A fifth pulse interval T5 is a pulse interval between the two pulses corresponding to the K-color toner pattern 101K arranged downstream of the Y-color toner pattern 101Y.

A positional shift of the Y-color toner-image formation position includes a positional shift in a main-scanning direction along a rotation axis of the photoconductor 51 (see FIG. 2) and a positional shift in a sub-scanning direction along a rotating direction of the photoconductor 51.

If the Y-color toner-image formation position is shifted from the above-described reference position in the main-scanning direction, the Y-color toner pattern 101Y is shifted from the K-color toner pattern 101K in a direction orthogonal to the moving direction of the intermediate transfer belt 61 (the direction indicated by the arrow C in FIG. 5A). Such a positional shift between toner patterns appears as a difference between the third pulse interval T3 and the first pulse interval T1 or a difference between the third pulse interval T3 and the fifth pulse interval T5.

Owing to this, in the first exemplary embodiment, a positional shift amount L of a toner-image formation position in the main-scanning direction is calculated by Expression (1) using a pulse interval acquired for a toner pattern having two arms with an angle (pattern angle) of 27° as described above:

$$L=(T1+T5)/2-T3 \quad (1).$$

When the registration mark 100 used for the calculation of the positional shift amount L in the main-scanning direction is formed, the registration processing using the adjustment value currently stored on the memory 40*a* of the main controller 40 is used. The positional shift amount indicated by the value L generated with Expression (1) is a positional shift amount in the main-scanning direction that is present because the shift is not completely adjusted even by the registration processing.

Also, in this exemplary embodiment, the registration mark 100 includes the plural Y-color toner patterns 101Y as described above. An average value of values L generated with Expression (1) respectively for the plural Y-color toner patterns 101Y is employed as a positional shift amount in the main-scanning direction. In the following description, a letter "L" is applied to the finally acquired positional shift amount in the main-scanning direction.

When the positional shift amount L in the main-scanning direction is calculated, the main controller 40 shown in FIG. 2 corrects the current adjustment value in the main-scanning direction such that the toner-image formation position is shifted in a direction opposite to the direction of the positional shift with the amount indicated by the value L, and hence generates a new adjustment value in the main-scanning direction.

If the Y-color toner-image formation position is shifted in the sub-scanning direction, the Y-color toner pattern 101Y becomes close to one K-color toner pattern 101K in the moving direction of the intermediate transfer belt 61 (the direction indicated by the arrow C in FIG. 5A). In this case, the interval between the Y-color toner pattern 101Y and the K-color toner pattern 101K arranged above the Y-color toner pattern 101Y in the figure differs from the interval between the Y-color toner pattern 101Y and the K-color toner pattern 101K arranged below the Y-color toner pattern 101Y in the figure.

In the first exemplary embodiment, (T1/2+T2+T3/2) is employed as a value indicative of the interval between the Y-color toner pattern 101Y and the K-color toner pattern 101K arranged above the Y-color toner pattern 101Y in the figure. Also, (T5/2+T4+T3/2) is employed as a value indicative of the interval between the Y-color toner pattern 101Y and the K-color toner pattern 101K arranged below the Y-color toner pattern 101Y in the figure. Then, a positional shift amount P of a toner-image formation position in the sub-scanning direction is calculated by using Expression (2) as follows:

$$P=(T1/2+T2)/2-(T5/2+T4)/2 \quad (2).$$

In this exemplary embodiment, an average value of values P generated with Expression (2) respectively for the plural Y-color toner patterns 101Y is employed as a positional shift amount in the sub-scanning direction. In the following description, a letter "P" is applied to the finally acquired positional shift amount in the sub-scanning direction.

When the positional shift amount P in the sub-scanning direction is calculated, the main controller 40 shown in FIG. 2 corrects the current adjustment value in the sub-scanning direction such that the toner-image formation position is shifted in a direction opposite to the direction of the positional shift with the amount indicated by the value P, and hence generates a new adjustment value in the sub-scanning direction.

New adjustment values for MC colors are generated by the same generation method as that of Y color.

The adjustment values on the memory 40*a* of the main controller 40 are updated by the newly generated adjustment values. The new adjustment values are used for the registration processing until next new adjustment values are generated.

In the first exemplary embodiment, the adjustment values for YMC colors are calculated by using the pulse intervals relating to the two K-color toner patterns arranged on both sides of each of the toner patterns for YMC colors. Alternatively, each of the adjustment values for YMC colors may be calculated by using a pulse interval relating to a single K-color toner pattern next to each of the toner patterns for YMC colors.

In general, toner images formed with toners of YMCK colors have spectral reflectances as follows.

Figure 6:
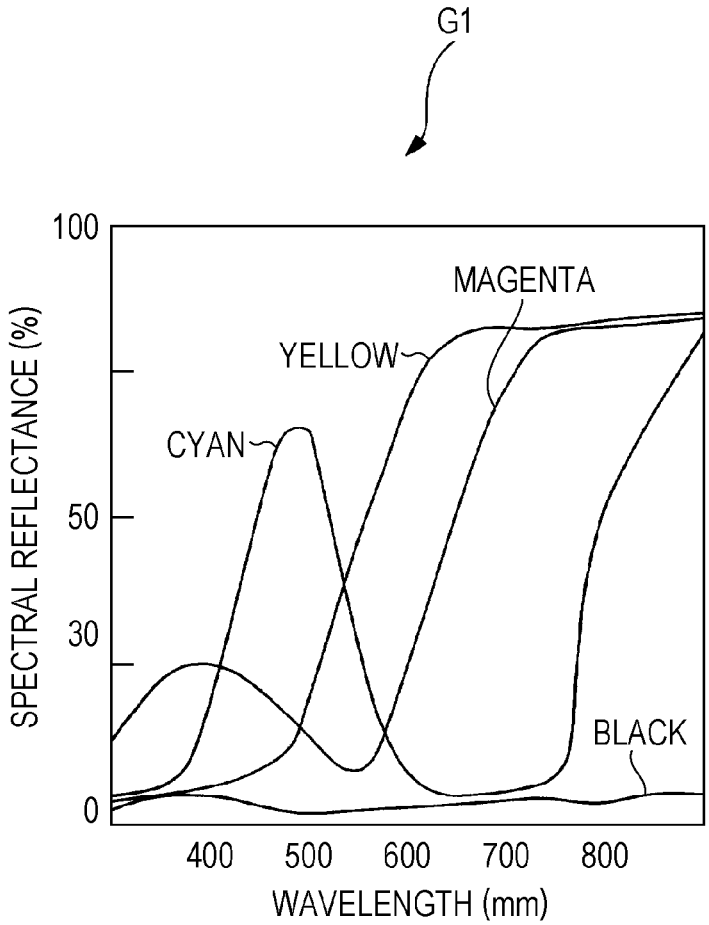
FIG. 6 is a graph showing spectral reflectances of toner images formed with toners of YMCK colors.

FIG. 6 is a graph showing spectral reflectances of toner images formed with toners of YMCK colors.

In a graph G1 shown in FIG. 6, the horizontal axis plots a wavelength of light and the vertical axis plots a spectral reflectance. The graph G1 has curves each indicative of a change in spectral reflectance with respect to a wavelength of light, for a toner image formed with a toner of each of YMCK colors.

In the first exemplary embodiment, a wavelength of light emitted from the light emitting portion 71 of the optical sensor 70 shown in FIG. 2 is 940 nm as described above. As it is found from the graph G1 shown in FIG. 6, the toner images of three YMC colors have spectral reflectances higher than the spectral reflectance of the K-color toner image, with respect to the light with the wavelength of 940 nm.

The K-color toner pattern 101K in the multi-color registration mark 100 shown in FIG. 3A has a structure in which the K-color outer patterns 103K having the relatively low spectral reflectance are arranged on both sides in the moving direction indicated by the arrow C of the C-color inner pattern 102C having the relatively high spectral reflectance.

The Y-color toner pattern 101Y in the multi-color registration mark 100 has a structure in which the Y-color outer pattern 103Y having the relatively high spectral reflectance is arranged on both sides in the moving direction indicated by the arrow C of the K-color inner pattern 102K having the relatively low spectral reflectance.

The M-color toner pattern 101M in the multi-color registration mark 100 has a structure in which the M-color outer pattern 103M having the relatively high spectral reflectance is arranged on both sides in the moving direction indicated by the arrow C of the K-color inner pattern 102K having the relatively low spectral reflectance.

The C-color toner pattern 101C in the multi-color registration mark 100 has a structure in which the C-color outer pattern 103C having the relatively high spectral reflectance is arranged on both sides in the moving direction indicated by the arrow C of the K-color inner pattern 102K having the relatively low spectral reflectance.

The waveform of an output signal from the light receiving portion 72 of the optical sensor 70 shown in FIG. 2 varies among the multi-color registration mark 100 and the single-color registration mark 200 used in the first exemplary embodiment.

First, the waveform of the output signal acquired for the single-color registration mark 200 is described.

Figure 7:
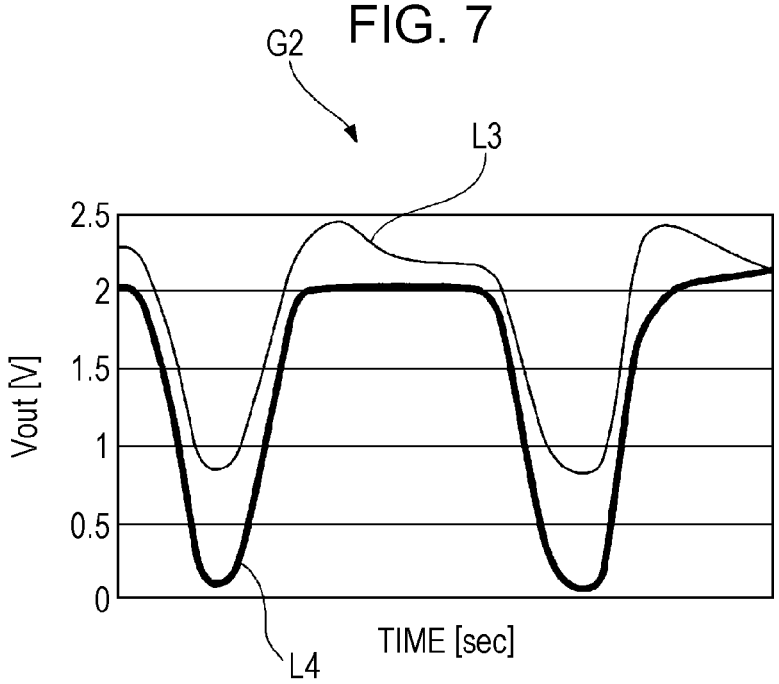
FIG. 7 is a graph showing output signals from the light receiving portion, acquired for a single-color registration mark shown in FIG. 3B.

FIG. 7 is a graph showing output signals from the light receiving portion, acquired for the single-color registration mark shown in FIG. 3B.

In a graph G2 of FIG. 7, the vertical axis plots a level (voltage) of the output signal from the light receiving portion 72 and the horizontal axis plots a time. The time along the horizontal axis is acquired by converting the moving distance of the spot SP on the intermediate transfer belt 61 since the light receiving portion 72 starts receiving the reflected light in response to the instruction from the main controller 40, into an elapsed time since the start of the reception of the light.

The graph G2 illustrates a third line L3 indicative of an output signal acquired for a C-color toner pattern and a fourth line L4 indicative of an output signal acquired for a K-color toner pattern.

In the graph G2, the time axis of the third line L3 is shifted so that a position at which the signal level decreases is almost aligned with a position at which the signal level decreases in the fourth line L4.

As it is found from the graph G2, the waveform of the output signal acquired for the K-color toner pattern is not aligned with the waveform of the output signal acquired for the C-color toner pattern. To be more specific, the decrease amount of the level of the output signal acquired for the K-color toner pattern is larger than the decrease amount of the level of the output signal acquired for the C-color toner pattern.

In general, reflected light reflected by a toner image includes reflected light that is reflected while being diffused at the surface of the toner image and spreading around (diffused reflected light), in addition to reflected light that is reflected by specular reflection at the surface of the toner image (specular reflected light).

Regarding the K-color toner pattern, the amount of diffused reflected light is very small because the spectral reflectance is small, and a decrease in specular reflected light when the spot SP of the light emitted from the light emitting portion 71 passes across the toner pattern appears substantially directly as a decrease in level of the output signal from the light receiving portion 72.

In contrast, the C-color toner pattern has a higher spectral reflectance than that of the K-color toner pattern. Owing to this, since the diffused reflected light of a certain value is received by the light receiving portion 72 even if the specular reflected light decreases when the spot SP of the light passes across the toner pattern, the decrease amount of the level of the output signal from the light receiving portion 72 is smaller than that of the K-color toner pattern.

Also, regarding either of the Y-color and M-color toner patterns, the decrease amount of the level of the output signal from the light receiving portion 72 becomes smaller than that of the K-color toner pattern by the effect of the diffused reflected light like the C-color toner pattern.

As described above, the adjustment values used for the registration processing are generated by using Expression (1) and Expression (2). These expressions use the pulse intervals T1 to T5 in the pulsed signal shown in FIG. 5C and acquired by binarizing the output signal from the light receiving portion 72.

The positional shift amounts L and P in the main-scanning direction and sub-scanning direction calculated by these expressions become "0" if the waveform of the output signal of K color is aligned with each of the waveforms of the output signals of YMC colors and hence the toner-image formation positions of the respective colors are not shifted from each other. In such a case, the adjustment values stored currently on the memory 40*a* of the main controller 40 are continuously used for the next registration processing.

As shown in the graph G2 in FIG. 7, with the single-color registration mark 200, the waveform of the output signal for K color is not aligned with each of the waveforms of the output signals for YMC colors. Consequently, misalignment may likely occur among the first, third, and fifth pulse intervals T1, T3, and T5 which should be aligned with each other if there is no shift among the toner-image formation positions of the respective colors. Similarly, misalignment may also likely occur between the second and fourth pulse intervals T2 and T4.

Such misalignment among the pulse intervals T1 to T5 may give a certain value (offset value) to the positional shift amounts L and P in the main-scanning direction and sub-scanning direction, even if the toner-image formation positions of the respective colors are not shifted from each other. Such an offset value may increase calculation errors of the positional shift amounts L and P in the main-scanning direction and sub-scanning direction.

Described next is the waveform of the output signal from the light receiving portion 72 of the optical sensor 70 shown in FIG. 2 acquired for the multi-color registration mark 100 shown in FIG. 3A.

Figure 8:
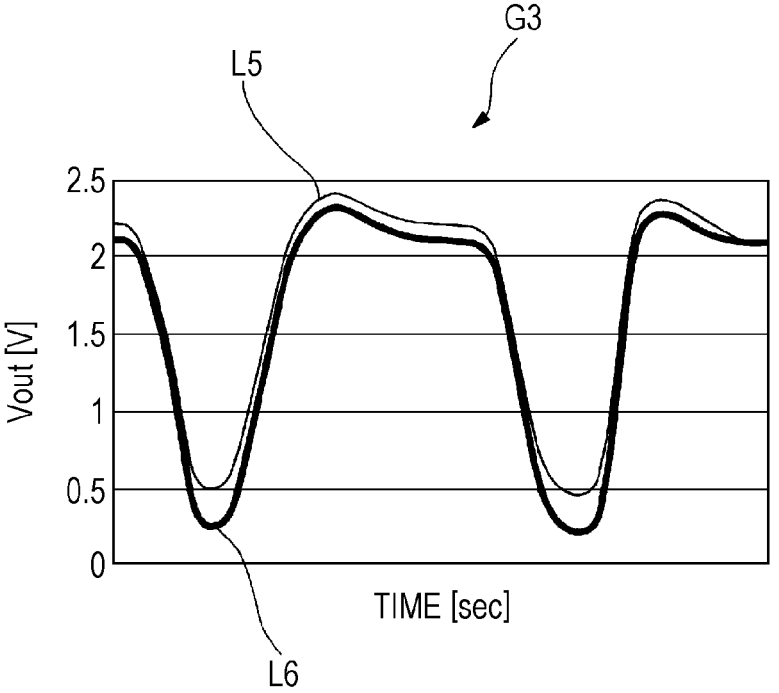
FIG. 8 is a graph showing output signals from the light receiving portion, acquired for the multi-color registration mark shown in FIG. 3A.

FIG. 8 is a graph showing output signals from the light receiving portion, acquired for the multi-color registration mark shown in FIG. 3A.

In a graph G3 of FIG. 8, the vertical axis plots a level (voltage) of the output signal from the light receiving portion 72 and the horizontal axis plots a time. The time along the horizontal axis in the graph G3 is acquired by converting the moving distance of the spot SP on the intermediate transfer belt 61 since the light receiving portion 72 starts receiving the reflected light, into an elapsed time since the start of the reception of the light. The graph G3 illustrates a fifth line L5 indicative of an output signal acquired for a C-color toner pattern and a sixth line L6 indicative of an output signal acquired for a K-color toner pattern.

In the graph G3, like the above-described graph G2 of FIG. 7, the time axis of the fifth line L5 is shifted so that a position at which the signal level decreases is almost aligned with a position at which the signal level decreases in the sixth line L6.

As it is found from the graph G3, in the multi-color registration mark 100, the difference between the waveform of the output signal acquired for the K-color toner pattern and the waveform of the output signal acquired for the C-color toner pattern is smaller than the difference with the single-color registration mark 200.

For the K-color toner pattern, a decrease in level of the output signal from the light receiving portion 72 when the spot SP of the light emitted from the light emitting portion 71 passes across the toner pattern is restricted by the diffused reflected light from the C-color inner pattern.

Owing to this, with the multi-color registration mark 100, the waveform of the output signal acquired for the K-color toner pattern is close to the waveform of the output signal acquired for each of the toner patterns for YMC colors, as compared with the single-color registration mark 200.

Also, with the multi-color registration mark 100, for the C-color toner pattern, the diffused reflected light is restricted by the K-color inner pattern. Consequently, a decrease in level of the output signal from the light receiving portion 72 when the spot SP of the light emitted from the light emitting portion 71 passes across the toner pattern is promoted.

Owing to this, with the multi-color registration mark 100, the waveform of the output signal acquired for the C-color toner pattern is close to the waveform of the output signal acquired for the K-color toner pattern, as compared with the single-color registration mark 200.

Also, for the Y-color and M-color toner patterns, like the C-color toner pattern, diffused reflected light is restricted because of the K-color inner pattern, and a decrease in level of the output signal from the light receiving portion 72 is promoted. Owing to this, with the multi-color registration mark 100, the waveform of the output signal acquired for each of the toner patterns for YMC colors is close to the waveform of the output signal acquired for the K-color toner pattern, as compared with the single-color registration mark 200.

As described above, with the multi-color registration mark 100, the difference between the waveform of the output signal acquired for the K-color toner pattern and the waveform of the output signal acquired for each of the toner patterns for YMC colors is smaller than the difference with the single-color registration mark 200.

Hence, with the multi-color registration mark 100, the degree of misalignment among the above-described pulse intervals T1 to T5 is smaller than that of the single-color registration mark 200. Also, the above-described offset value of the multi-color registration mark 100 is smaller than that of the single-color registration mark 200. That is, with the multi-color registration mark 100, calculation errors of the positional shift amounts L and P in the main-scanning direction and sub-scanning direction are reduced.

Further, with the multi-color registration mark 100, the waveform of the output signal for K color is almost aligned with each of the waveforms of the output signals for YMC colors such that the difference is almost negligible in a portion of the signal level that is compared with the threshold TH during the binarization described with reference to FIGS. 5A to 5C. Hence, with the multi-color registration mark 100, it is assumed that the offset value is substantially "0." Accordingly, with the multi-color registration mark 100, it is assumed that the calculation errors of the positional shift amounts L and P in the main-scanning direction and sub-scanning direction are substantially "0."

With the multi-color registration mark 100, the calculation errors of the positional shift amounts are assumed as almost "0" only if the multi-color registration mark 100 is a normal mark in which the inner pattern is arranged inside the outer patterns.

If the formation of the multi-color registration mark 100 is failed and the inner pattern protrudes from the outer pattern, the difference between the waveform of the output signal for K color and each of the waveforms of the output signals for YMC colors becomes large, and as the result, the calculation errors of the positional shift amounts may increase.

In other words, based on the multi-color registration mark 100, the positional shift amounts calculated with high accuracy such that the calculation errors are substantially "0" are positional shift amounts in a range that avoids a formation failure of the multi-color registration mark 100 and allows the inner pattern to be arranged inside the outer patterns.

In contrast, with the single-color registration mark 200, the calculation errors are large as compared with those of the normal multi-color registration mark 100. However, with the single-color registration mark 200, even if the positional shift amounts are large by certain degree, as long as the individual toner patterns are discriminated, the positional shift amounts are calculated without calculation errors increasing.

Discriminating the individual toner patterns represents that neighbor toner patterns are not overlaid or are only overlaid so that the toner patterns are allowed to be discriminated from each other, and the spot SP of the light emitted from the light emitting portion 71 passes across two arms of each toner pattern. That is, with the single-color registration mark 200, the positional shift amounts are calculated upon assumption that formation of the individual toner patterns are successful if the individual toner patterns are discriminated from each other.

As described above, with the single-color registration mark 200, the range of the positional shift amounts that avoids a formation failure is larger than the range with the multi-color registration mark 100.

In the first exemplary embodiment, the multi-color registration mark 100 and the single-color registration mark 200 having different calculation errors of the positional shift amounts and different ranges of the positional shift amounts that avoid a formation failure are formed in processing described in the flowchart which will be described below.

The single-color registration mark 200 corresponds to an example of a first registration mark. Also, the multi-color registration mark 100 corresponds to an example of a second registration mark.

Hereinafter, processing of generating the adjustment values for the registration processing by using the multi-color registration mark 100 and the single-color registration mark 200 is described below.

Figure 9:
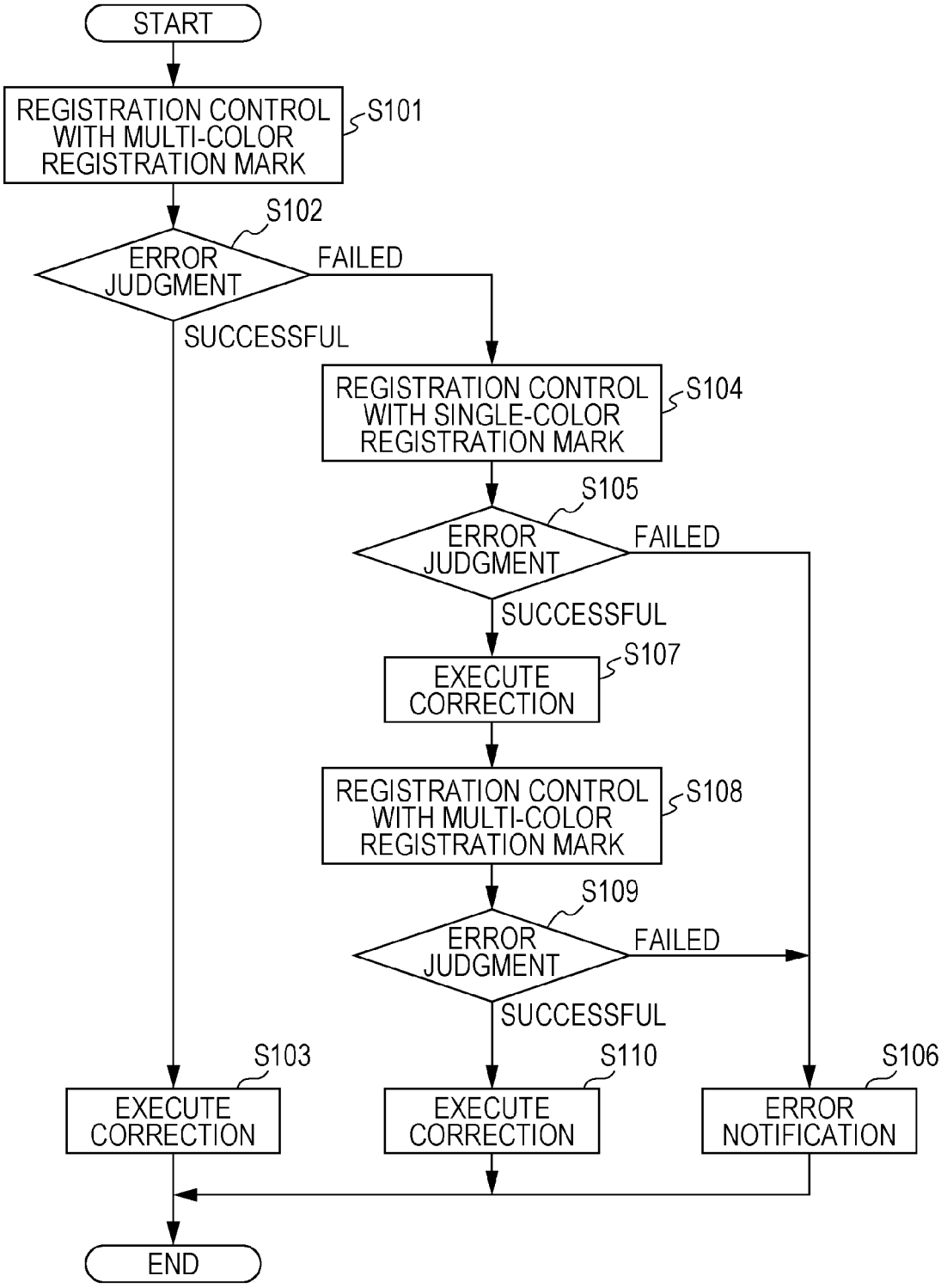
FIG. 9 is a flowchart describing processing of generating adjustment values used for registration processing.

FIG. 9 is a flowchart describing processing of generating the adjustment values used for the registration processing.

The processing described in the flowchart is started by the main controller 40, after any of the various phenomena such as image formation by a predetermined number of sheets occurs, if the adjustment-value generation request flag is set at a timing at which processing such as a print operation is ended.

When the processing is started, the main controller 40 first causes the four image forming units 50Y, 50M, 50C, and 50K to form the multi-color registration mark 100 shown in FIG. 3A on the intermediate transfer belt 61 (step S101). The multi-color registration mark 100 is formed through the registration processing using the adjustment values stored on the memory 40*a* at the time of the formation.

Further, in step S101, the main controller 40 causes the light emitting portion 71 of the optical sensor 70 shown in FIG. 2 to emit light and causes the light receiving portion 72 to receive reflected light and to output an output signal. The output signal from the light receiving portion 72 is input to the main controller 40. The main controller 40 binarizes the output signal and acquires a pulsed signal as described with reference to FIGS. 5A to 5C.

Then, the main controller 40 calculates the positional shift amounts in the main-scanning direction and sub-scanning direction for YMC colors based on the pulsed signal by using Expressions (1) and (2).

Then, the main controller 40 judges whether or not the multi-color registration mark 100 formed in step S101 is a normal mark based on the pulsed signal (step S102).

The main controller 40 first judges whether or not the calculated positional shift amounts in the main-scanning direction and sub-scanning direction are positional shift amounts within a range that allows the inner pattern to be arranged inside the outer patterns in the multi-color registration mark 100.

FIGS. 10A to 10D are illustrations each showing a range in which an inner pattern is arranged inside outer patterns, for a toner pattern of each of YMCK colors included in the multi-color registration mark.

Figure 10A:
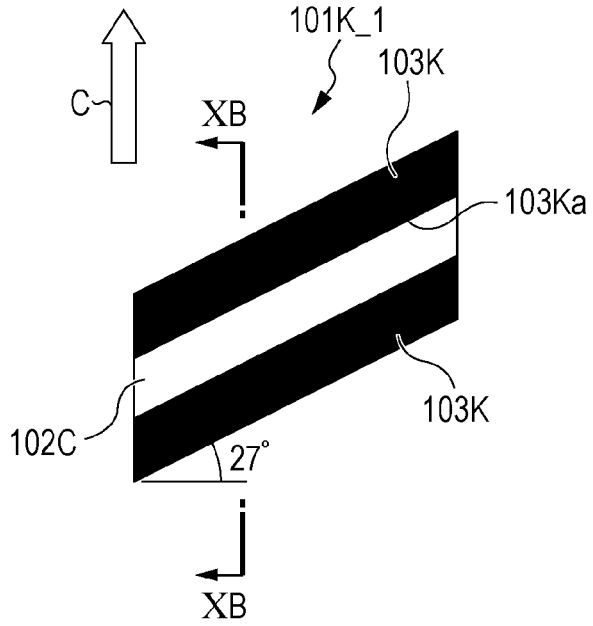
FIGS. 10A to 10D are illustrations each showing a range that allows an inner pattern to be arranged inside outer patterns, for a toner pattern of each of YMCK colors included in the multi-color registration mark.
Figure 10B:
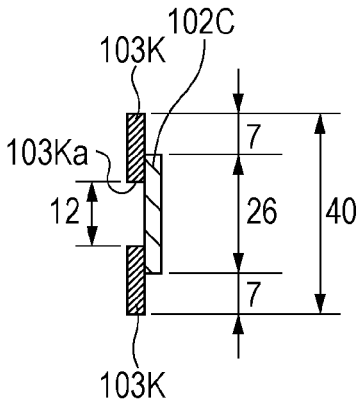

FIG. 10A is a top view of an arm 101K_1 of two arms of the K-color toner pattern 101K. FIG. 10B is a sectional view of the arm 101K_1 taken along a line XB-XB in FIG. 10A.

Figure 10C:
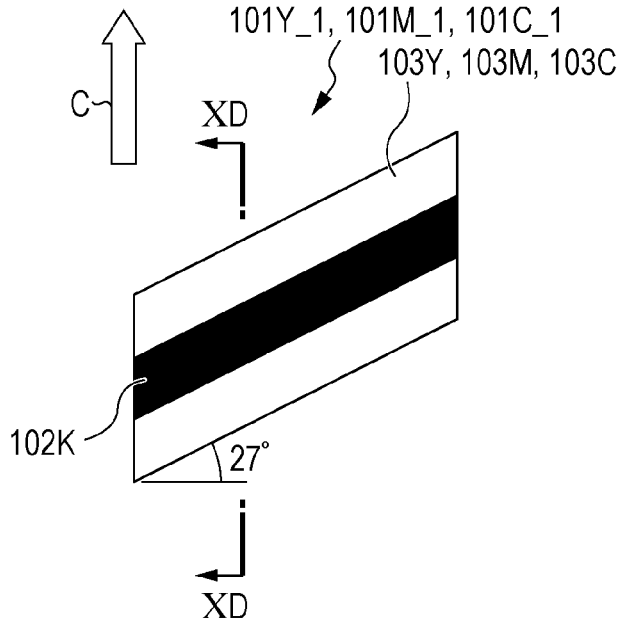
Figure 10D:
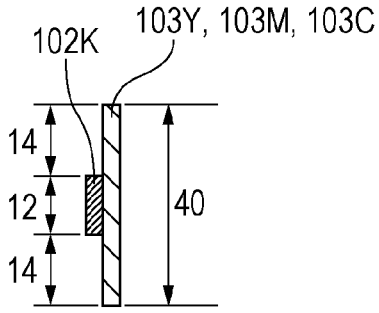

FIG. 10C is a top view of either of arms 101Y_1, 101M_1, and 101C_1 of every two arms of the toner patterns 101Y, 101M, and 101C for YMC colors. FIG. 10D is a sectional view of either of the arms 101Y_1, 101M_1, and 101C_1 taken along a line XD-XD in FIG. 10C.

As described above with reference to FIG. 2, the toner images with the toners of the respective colors formed by the image forming units 50Y, 50M, 50C, and 50K are transferred on the intermediate transfer belt 61 such that the toner images are overlaid on each other in order of YMCK.

Owing to this, as shown in FIG. 10B, the K-color toner pattern 101K is formed such that the K-color outer patterns 103K are overlaid on the C-color inner pattern 102C. In the K-color toner pattern 101K, the K-color outer patterns 103K are patterns having a width of 40 dots with a gap 103Ka of 12 dots through which the C-color inner pattern 102C is exposed. The C-color inner pattern 102C has a width of 26 dots containing portions that are hidden by the K-color outer patterns 103K.

In the K-color toner pattern 101K, the C-color inner pattern 102C is arranged inside the K-color outer patterns 103K if a positional shift in the moving direction of the intermediate transfer belt 61 indicated by the arrow C in the figure is smaller than 7 dots.

In contrast, the toner patterns 101Y, 101M, and 101C of YMC colors have structures in which the K-color inner patterns 102K are overlaid on the outer patterns 103Y, 103M, and 103C for YMC colors. In the toner patterns 101Y, 101M, and 101C of YMC colors, the outer patterns 103Y, 103M, and 103C for YMC colors are patterns each having a width of 40 dots and being filled with toners without a gap. The K-color inner patterns 102K each have a width of 12 dots.

In the toner patterns 101Y, 101M, and 101C for YMC colors, if positional shifts of the outer patterns 103Y, 103M, and 103C of YMC colors each are smaller than 14 dots, the K-color inner patterns 102K are arranged inside the corresponding outer patterns.

The positional shift of each toner-image formation position includes a positional shift in the main-scanning direction orthogonal to the moving direction of the intermediate transfer belt 61 and a positional shift in the sub-scanning direction parallel to the moving direction as described above. In this first exemplary embodiment, the arms of each toner pattern in the multi-color registration mark 100 is inclined by 27° with respect to the main-scanning direction orthogonal to the moving direction of the intermediate transfer belt 61 as described above. Owing to this, the positional shift in the main-scanning direction causes a positional shift in the moving direction of the intermediate transfer belt 61 to be generated at the inner pattern in the toner pattern by an amount corresponding to ½ of the positional shift amount in the main-scanning direction in accordance with the inclination angle of 27°. That is, the positional shift amount of the inner pattern in the moving direction of the intermediate transfer belt 61 is the sum of the value corresponding to ½ of the positional shift amount in the main-scanning direction and the positional shift amount in the sub-scanning direction.

In step S102 of FIG. 9, it is judged whether or not positional shift amounts Lc and Pc in the main-scanning direction and sub-scanning direction calculated for C color are positional shift amounts within a range that allows the C-color inner pattern 102C to be arranged inside the K-color outer pattern 103K, by using Expression (3):

$$|Lc/2|+|Pc|<7 \quad (3).$$

Also, it is judged whether or not positional shift amounts Ly, Lm, Py, and Pm in the main-scanning direction and sub-scanning direction calculated for YM colors are positional shift amounts within a range that allows the K-color inner patterns 102K to be arranged inside the outer patterns 103Y and 103M, by using Expressions (4) and (5):

$$|Ly/2|+|Py|<14 \quad (4);$$

$$|Lm/2|+|Pm|<14 \quad (5).$$

In step S102 of FIG. 9, the judgment based on these expressions is made for each of YMC colors.

In the first exemplary embodiment, the judgment for the positional shift amounts is made by using the expressions in which the range that allows the inner patterns to be arranged inside the outer patterns for C color differs from the range for each of YM colors. However, the judgment for the positional shift amounts may be made for YM colors by using Judgment Expression (3) for C color having the smallest range that allows the inner pattern to be arranged inside the outer patterns.

Also, in the first exemplary embodiment, it is judged whether or not the inner pattern is arranged inside the outer patterns, by judging whether or not the calculated positional shift amounts are positional shift amounts within the range expressed by Expressions (3) to (5). However, the judgment whether or not the inner pattern is arranged inside the outer patterns is not limited thereto. For example, as described later, judgment may be made whether or not the width of the toner pattern exceeds a reference value.

Figure 11A:
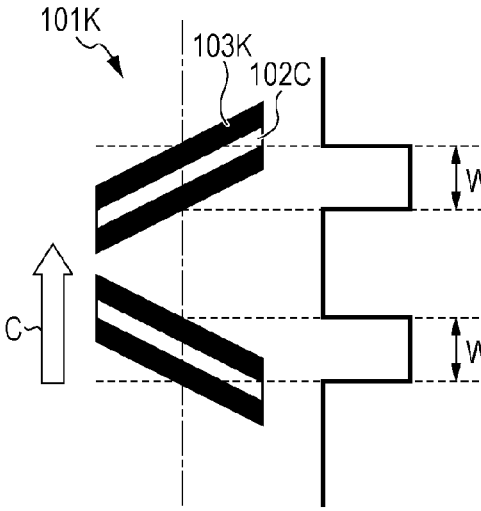
FIGS. 11A and 11B are illustrations showing a toner pattern in which an inner pattern is arranged inside outer patterns, and a toner pattern in which an inner pattern protrudes from an outer pattern.
Figure 11B:
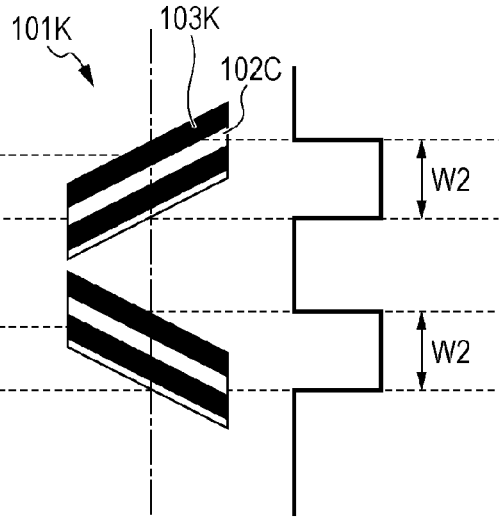

FIGS. 11A and 11B are illustrations showing a toner pattern in which an inner pattern is arranged inside outer patterns, and a toner pattern in which an inner pattern protrudes from an outer pattern.

FIG. 11A illustrates the K-color toner pattern 101K when the C-color inner pattern 102C is arranged inside the K-color outer patterns 103K. FIG. 11A shows a pulsed signal that is acquired if the C-color inner pattern 102C is arranged inside the K-color outer patterns 103K.

Also, FIG. 11B illustrates a state in which the C-color inner pattern 102C protrudes from the K-color outer pattern 103K because of a C-color positional shift in a direction opposite to the moving direction of the intermediate transfer belt 61 indicated by the arrow C in the figure. FIG. 11B shows a pulsed signal that is acquired if the C-color inner pattern 102C protrudes from the K-color outer pattern 103K.

As shown in FIGS. 11A and 11B, the width of the K-color toner pattern 101K is equivalent to a pulse width W1 and a pulse width W2 in the pulsed signals acquired for the K-color toner pattern 101K.

The pulse width W2 acquired when the C-color inner pattern 102C protrudes from the K-color outer pattern 103K is larger than the pulse width W1 acquired when the C-color inner pattern 102C is arranged inside the K-color outer patterns 103K. This situation may occur similarly in the case of the width of the toner patterns 101K for YM colors.

In the first exemplary embodiment, a design width acquired when the inner pattern is arranged inside the outer patterns is 40 dots as shown in FIGS. 4 and 10A to 10D. Hence, if the pulse width corresponding to the design width of 40 dots is used as a reference value, it may be judged whether or not the inner pattern is arranged inside the outer patterns. That is, it is judged whether or not the pulse width of each pulse in the pulsed signal acquired for the toner pattern for each color exceeds this reference value. In this case, the pulse width corresponding to 40 dots is stored as the reference value on the memory 40*a* of the main controller 40 shown in FIG. 2 in a factory.

Also, in the first exemplary embodiment, the single-color registration mark 200 in FIG. 3B is formed as described later. The toner pattern of the single-color registration mark 200 has a width equivalent to the width of the toner pattern in the multi-color registration mark 100 when the inner pattern is arranged inside the outer patterns. Hence, the pulse width of each pulse in the pulsed signal acquired for the toner pattern in the single-color registration mark 200 may be used as a reference value for the judgment. In this case, when the single-color registration mark 200 is formed, the pulse width of the toner pattern is generated by the main controller 40 shown in FIG. 2 and is stored on the memory 40*a* as the reference value.

The description for another example of the method of judging whether or not the inner pattern is arranged inside the outer patterns, the example which differs from the first exemplary embodiment, with reference to FIGS. 11A and 11B is ended. Now, the description returns to the description for the flowchart in FIG. 9.

In the first exemplary embodiment, in step S102, it is judged whether or not the inner pattern is arranged inside the outer patterns, by judging whether or not the calculated positional shift amounts are positional shift amounts within the ranges expressed by Expressions (3) to (5) as described above.

Further, in step S102, the main controller 40 judges whether or not the number of pulses included in the pulsed signal acquired for the multi-color registration mark 100 is a number that is twice the number of toner patterns included in the multi-color registration mark 100.

As it is found from FIGS. 5A to 5C, in the normal multi-color registration mark 100, a single pulse is acquired in correspondence with each of two arms of each toner pattern. That is, in the normal multi-color registration mark 100, the pulses are acquired by the number that is twice the number of toner patterns included in the multi-color registration mark 100. A single pulse is acquired for every single arm of each toner pattern also in the case of the normal single-color registration mark 200.

In contrast, for example, if neighbor toner patterns are overlaid on each other by degree that the toner patterns are not discriminated, or if either toner pattern is shifted to a position deviated from a passing line of the spot SP of the light emitted from the light emitting portion 71, the number of pulses may differ from the number that is twice the number of patterns.

In the first exemplary embodiment, the number of toner patterns in the multi-color registration mark 100 is equivalent to the number of toner patterns in the single-color registration mark 200. The number of patterns in the toner patterns is stored on the memory 40*a* of the main controller 40.

In step S102 of FIG. 9, the main controller 40 judges whether or not the number of pulses in the pulsed signal corresponds to the number that is twice the number of patterns stored on the memory 40*a*.

In step S102, the main controller 40 judges that the multi-color registration mark 100 is a normal mark if the calculated positional shift amounts are within the above-described ranges and the number of pulses corresponds to the number that is twice the number of patterns.

If it is judged that the multi-color registration mark 100 is a normal mark (successful in step S102), the processing goes to step S103.

In step S103, the main controller 40 corrects the current adjustment values on the memory 40*a* and generates new adjustment values such that the toner-image formation positions are shifted in a direction opposite to the direction of the positional shifts by the positional shift amounts calculated in step S102. The main controller 40 updates the current adjustment values on the memory 40*a* to the new adjustment values.

If it is judged that the multi-color registration mark 100 is not the normal mark (failed in step S102), the processing goes to step S104.

In step S104, the main controller 40 causes the single-color registration mark 200 shown in FIG. 3B to be formed. The single-color registration mark 200 is formed in step S104 through the registration processing using the adjustment values stored on the memory 40*a* at the time of the formation.

As described above, in the first exemplary embodiment, the registration mark that is formed when it is judged that the multi-color registration mark 100 is not the normal mark is the single-color registration mark 200 including the toner patterns respectively formed with only the toners of YMCK colors. Meanwhile, the registration mark formed in such a case may be a multi-color registration mark according to a second exemplary embodiment, which will be described later. In the first exemplary embodiment, toner consumption when a registration mark is formed is restricted as compared with the case in which the two types of multi-color registration marks are formed.

In step S104, further, the main controller 40 causes the light emitting portion 71 of the optical sensor 70 shown in FIG. 2 to emit light and causes the light receiving portion 72 to receive reflected light and to output an output signal. The output signal from the light receiving portion 72 is input to the main controller 40. The main controller 40 binarizes the output signal and acquires a pulsed signal as described with reference to FIGS. 5A to 5C.

The main controller 40 judges whether or not the single-color registration mark 200 is a normal mark based on the pulsed signal (step S105).

The judgment in step S105 differs from the judgment in step S102 described above. It is only judged whether or not the number of pulses in the pulsed signal corresponds to the number that is twice the number of patterns stored on the memory 40*a*.

If it is judged that the single-color registration mark 200 is not the normal mark (failed in step S105), this represents the following. Even the single-color registration mark 200, which has a relatively high possibility of avoiding a formation failure among the two types of registration marks, is not normally formed. In this case, a part in the image forming unit 50Y, 50M, 50C, or 50K, or the optical sensor 70 may be broken and adjustment for positional shifts may be unavailable. In this case, in the first exemplary embodiment, the main controller 40 displays a message on the display operation unit 14 shown in FIG. 1 to make notification for an error occurrence (step S106).

In contrast, if it is judged that the single-color registration mark 200 is the normal mark (successful in step S105), adjustment values for the registration processing are generated from the pulsed signal acquired in step S104 (step S107).

In step S107, the main controller 40 calculates the positional shift amounts L and P in the main-scanning direction and sub-scanning direction for each of YMC colors by using Expressions (1) and (2). Then, the main controller 40 acquires adjustment values for YMC colors to correct the calculated positional shift amounts of YMC colors, and updates the adjustment values stored on the memory 40*a* to the acquired adjustment values.

When the generation of the adjustment values for the registration processing is ended, the main controller 40 causes the multi-color registration mark 100 shown in FIG. 3A to be formed (step S108). The multi-color registration mark 100 is formed in step S108 through the registration processing using the adjustment values stored on the memory 40*a* at the time of the formation. It is to be noted that the adjustment values stored on the memory 40*a* at the time of step S108 is the adjustment values generated in step S107.

Further, in step S108, the main controller 40 causes the light emitting portion 71 to emit light, causes the light receiving portion 72 to receive reflected light and to output an output signal, binarizes the output signal, and hence acquires a pulsed signal. Further, the main controller 40 calculates the positional shift amounts L and P in the main-scanning direction and sub-scanning direction for YMC colors based on the pulsed signal by using Expressions (1) and (2).

Then, the main controller 40 judges whether or not the multi-color registration mark 100 formed in step S108 is the normal mark (step S109) through judgment similar to that in step S102.

If it is judged that the multi-color registration mark 100 is not the normal mark (failed in step S109), this represents the following. Even though the registration processing using the adjustment values based on the single-color registration mark 200 is executed, the normal multi-color registration mark 100 is not formed. In this case, a part in the image forming unit 50Y, 50M, 50C, or 50K, or the optical sensor 70 may be broken and adjustment for positional shifts may be unavailable. In this case, in the first exemplary embodiment, the processing goes to step S106, the main controller 40 displays a message on the display operation unit 14 shown in FIG. 1 to make notification for an error occurrence.

In contrast, if it is judged that the multi-color registration mark 100 is the normal mark (successful in step S109), the main controller 40 generates adjustment values of the respective colors for the registration processing (step S110) through processing similar to that in step S103. Then, the main controller 40 updates the adjustment values stored on the memory 40*a* to the acquired adjustment values.

As described above, in the first exemplary embodiment, if the current positional shifts of the toner-image formation positions are large enough to cause the formation of the normal multi-color registration mark 100 to be failed, the adjustment values are generated first by using the single-color registration mark 200. Then, the adjustment values are generated by using the multi-color registration mark 100 formed through the registration processing using the adjustment values with the single-color registration mark 200. Hence, even if the positional shifts of the current toner-image formation positions are large, toner images with plural colors are overlaid on each other with high accuracy through the registration processing using the finally acquired adjustment values.

The adjustment values are updated in step S103 or step S110, and the message for notification of an error occurrence is displayed in step S106. Then, the processing of generating the adjustment values for the registration processing shown in the flowchart of FIG. 9 is ended.

The processing from step S101 to step S103 in the flowchart of FIG. 9 corresponds to an example of a first adjustment process. The processing from step S104 to step S107 in the flowchart of FIG. 9 corresponds to an example of a second adjustment process. The processing from step S108 to step S110 in the flowchart of FIG. 9 corresponds to an example of a third adjustment process.

Also, the function of the main controller 40 for executing the processing in steps S102, S105, and S109 in the flowchart of FIG. 9 corresponds to an example of a mark judging unit. The function of the main controller 40 for executing the processing described in the flowchart of FIG. 9 corresponds to an example of an adjustment sequence controller.

Next, a second exemplary embodiment is described.

The second exemplary embodiment differs from the first exemplary embodiment in that if it is judged that the initially formed multi-color registration mark 100 is not the normal mark, a multi-color registration mark in a form different from the form of the former multi-color registration mark 100 is formed. However, a copier to which the second exemplary embodiment is applied and a basic flowchart for processing of generating adjustment values for registration processing are similar to those of the first exemplary embodiment. In the following description, points of the second exemplary embodiment different from the first exemplary embodiment are described, and common points are not redundantly described.

In the second exemplary embodiment, if it is judged that the initially formed multi-color registration mark is not the normal mark, i.e., in processing corresponding to step S104 in the flowchart shown in FIG. 9, a thin-line multi-color registration mark, which is described below, is formed.

Figure 12:
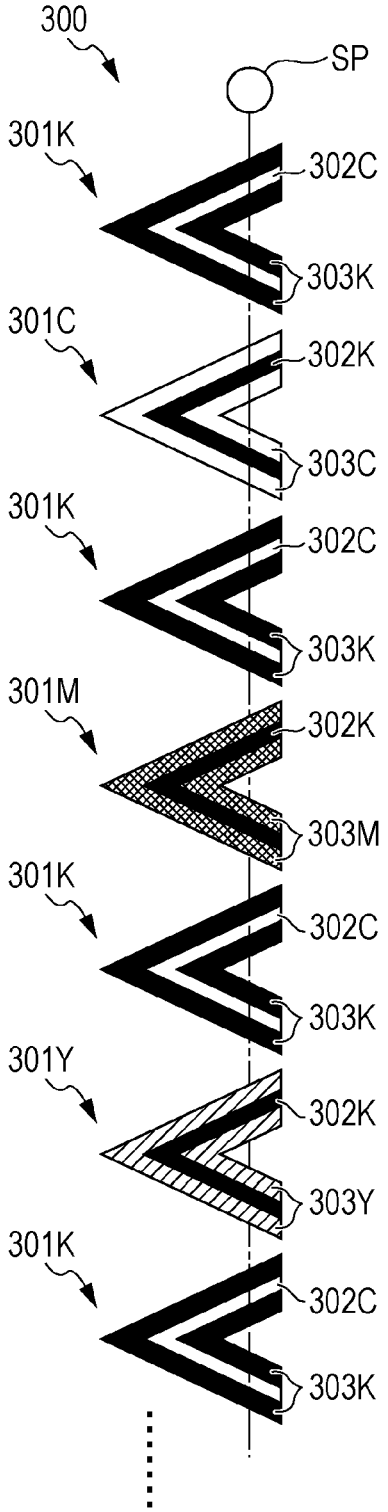
FIG. 12 is an illustration showing a thin-line multi-color registration mark that is formed if it is determined that an initially formed multi-color registration mark is not a normal mark according to a second embodiment.

FIG. 12 is an illustration showing the thin-line multi-color registration mark that is formed if it is determined that the initially formed multi-color registration mark is not the normal mark according to the second embodiment.

A thin-line multi-color registration mark 300 in FIG. 12 includes toner patterns 301Y, 301M, 301C, and 301K for YMCK colors.

The toner patterns 301Y, 301M, 301C, and 301K for YMCK colors each include an inner pattern 302C or 302K, which is of either of CK colors, and outer patterns 303Y, 303M, 303C, or 303K, which are of either of YMCK colors.

The pattern structures of the toner patterns 301Y, 301M, 301C, and 301K are basically the same as the pattern structures of the toner patterns 101Y, 101M, 101C, and 101K included in the above-described multi-color registration mark 100.

However, in the thin-line multi-color registration mark 300, the inner patterns 302C and 302K each have a width of 4 dots on an upper surface of the toner pattern. This width is smaller than the width (12 dots) of each of the inner patterns 102C and 102K in the multi-color registration mark 100.

In FIG. 12, all toner patterns for the respective colors in the thin-line multi-color registration mark 300 have inner patterns. However, the thin-line multi-color registration mark is not limited thereto. Only the K-color toner pattern may have the inner pattern, and the toner patterns for the other YMC colors may be respectively formed with only the toners of YMC colors.

Also, in FIG. 12, the K-color toner pattern 301K of the thin-line multi-color registration mark 300 has the C-color inner pattern 302C. Alternatively, the K-color toner pattern may have a Y-color inner pattern. Still alternatively, the K-color toner pattern may have an M-color inner pattern.

With the thin-line multi-color registration mark 300, calculation errors of positional shift amounts are reduced by actions of the inner patterns 302C and 302K of CK colors.

However, in the thin-line multi-color registration mark 300, the line width of each of the inner patterns 302C and 302K is smaller than the line width of each of the inner patterns 102C and 102K in the multi-color registration mark 100. As the result, with the thin-line multi-color registration mark 300, the calculation errors of the positional shift amounts increase as compared with those of the multi-color registration mark 100. Meanwhile, with the thin-line multi-color registration mark 300, a range of the positional shift amounts that avoids a formation failure of the thin-line multi-color registration mark 100 and allows the inner pattern to be arranged inside the outer patterns is larger than that of the multi-color registration mark 100.

As described above, regarding the thin-line multi-color registration mark 300, the calculation errors of the positional shift amounts increase and the range that avoids a formation failure is large as compared with the case of the multi-color registration mark 100, like the single-color registration mark 200 according to the first exemplary embodiment.

However, the calculation errors of the positional shift amounts calculated for the thin-line multi-color registration mark 300 are smaller than the calculation errors of the positional shift amounts calculated for the single-color registration mark 200 shown in FIG. 3B.

Owing to this, in the second exemplary embodiment, accuracy of the adjustment values generated by forming the thin-line multi-color registration mark 300 is higher than accuracy of the adjustment values generated by forming the single-color registration mark 200.

In the second exemplary embodiment, after the thin-line multi-color registration mark 300 is formed, it is judged whether or not the thin-line multi-color registration mark 300 is a normal mark in processing corresponding to step S105 in the flowchart shown in FIG. 9.

This judgment is made through processing similar to the judgment in steps S102 and S109 in the flowchart of FIG. 9.

In particular, with this judgment, it is judged whether or not the positional shift amounts calculated for the thin-line multi-color registration mark 300 are positional shift amounts within the range that allows the inner pattern to be arranged inside the outer patterns. Further, it is judged whether or not the number of pulses in a pulsed signal acquired for the thin-line multi-color registration mark 300 is a number that is twice the number of patterns of the thin-line multi-color registration mark 300.

However, regarding the thin-line multi-color registration mark 300, the range of the positional shift amounts that allows the inner pattern to be arranged inside the outer patterns is larger than that of the multi-color registration mark 100 as described above.

FIGS. 13A to 13D are illustrations each showing a range that allows an inner pattern to be arranged inside outer patterns, of a toner pattern for each of YMCK colors included in the thin-line multi-color registration mark.

Figure 13A:
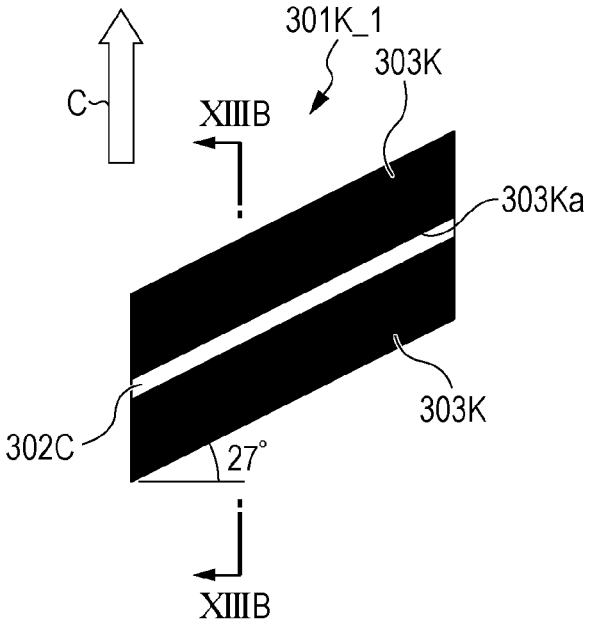
FIGS. 13A to 13D are illustrations each showing a range that allows an inner pattern to be arranged inside outer patterns, for a toner pattern of each of YMCK colors included in the thin-line multi-color registration mark.
Figure 13B:
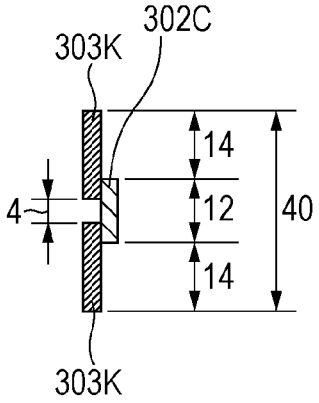

FIG. 13A is a top view of an arm 301K_1 of two arms of the K-color toner pattern 301K. FIG. 13B is a sectional view of the arm 301K_1 taken along a line XIIIB-XIIIB in FIG. 13A.

Figure 13C:
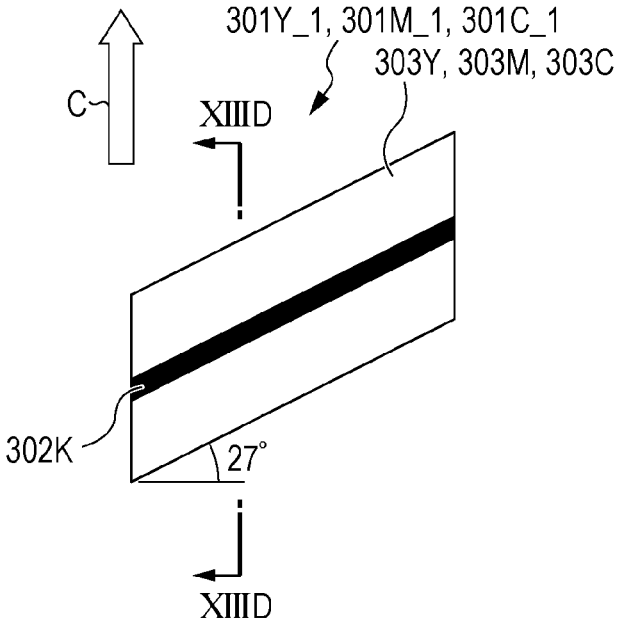
Figure 13D:
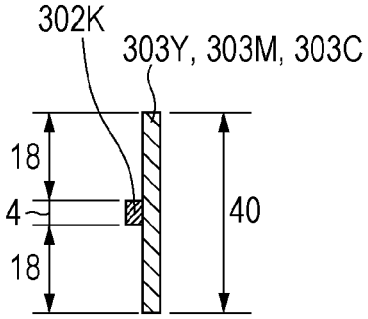

FIG. 13C is a top view of either of arms 301Y_1, 301M_1, and 301C_1 of every two arms of the toner patterns 301Y, 301M, and 301C for YMC colors. FIG. 13D is a sectional view of either of the arms 301Y_1, 301M_1, and 301C_1 taken along a line XIIID-XIIID in FIG. 13C.

As shown in FIG. 13B, the K-color toner pattern 301K is formed such that the K-color outer patterns 303K are overlaid on the C-color inner pattern 302C. In the K-color toner pattern 301K, the K-color outer patterns 303K are patterns having a width of 40 dots with a gap 303Ka of 4 dots through which the C-color inner pattern 302C is exposed. The C-color inner pattern 302C has a width of 12 dots containing portions that are hidden by the K-color outer patterns 303K.

In the K-color toner pattern 301K, the C-color inner pattern 302C is arranged inside the K-color outer patterns 303K if a positional shift in the moving direction of the intermediate transfer belt 61 indicated by the arrow C in the figure is smaller than 14 dots.

In contrast, the toner patterns 301Y, 301M, and 301C for YMC colors have structures in which the K-color inner patterns 302K are overlaid on the outer patterns 303Y, 303M, and 303C for YMC colors. In the toner patterns 301Y, 301M, and 301C for YMC colors, the outer patterns 303Y, 303M, and 303C for YMC colors are patterns each having a width of 40 dots and being filled with toners without a gap. The K-color inner pattern 302K has a width of 4 dots.

In the toner patterns 301Y, 301M, and 301C for YMC colors, if positional shifts of the outer patterns 303Y, 303M, and 303C for YMC colors each are smaller than 18 dots, the K-color inner patterns 302K are arranged inside the corresponding outer patterns.

In the second exemplary embodiment, it is judged whether or not positional shift amounts Lc and Pc in the main-scanning direction and sub-scanning direction calculated for C color are positional shift amounts within a range that allows the inner pattern 302C to be arranged inside the K-color outer patterns 303K, by using Expression (6):

$$|Lc/2|+|Pc|<14 \quad (6).$$

Also, it is judged whether or not positional shift amounts Ly, Lm, Py, and Pm in the main-scanning direction and sub-scanning direction calculated for YM colors are positional shift amounts within a range that allows the K-color inner patterns 302K to be arranged inside the outer patterns 303Y and 303M, by using Expressions (7) and (8):

$$|Ly/2|+|Py|<18 \quad (7);$$

$$|Lm/2|+|Pm|<18 \quad (8).$$

In the second exemplary embodiment, judgment is made for the positional shift amounts of YMC colors calculated for the thin-line multi-color registration mark 300 shown in FIG. 12 based on these expressions.

As described above, regarding the thin-line multi-color registration mark 300, the judgment reference for judging whether or not the mark is a normal mark more likely judges that the mark is a normal mark, as compared with the judgment reference for the multi-color registration mark 100.

Owing to this, in the second exemplary embodiment, frequency of judgment that the thin-line multi-color registration mark 300 is not a normal mark is reduced, as compared with a case in which the judgment reference for the thin-line multi-color registration mark 300 is the same as the judgment reference for the multi-color registration mark 100.

Next, a third exemplary embodiment is described.

The third exemplary embodiment is similar to the first exemplary embodiment except for processing of generating adjustment values used for registration processing. In the following description, points of the third exemplary embodiment different from the first exemplary embodiment are described, and common points are not redundantly described.

Figure 14:
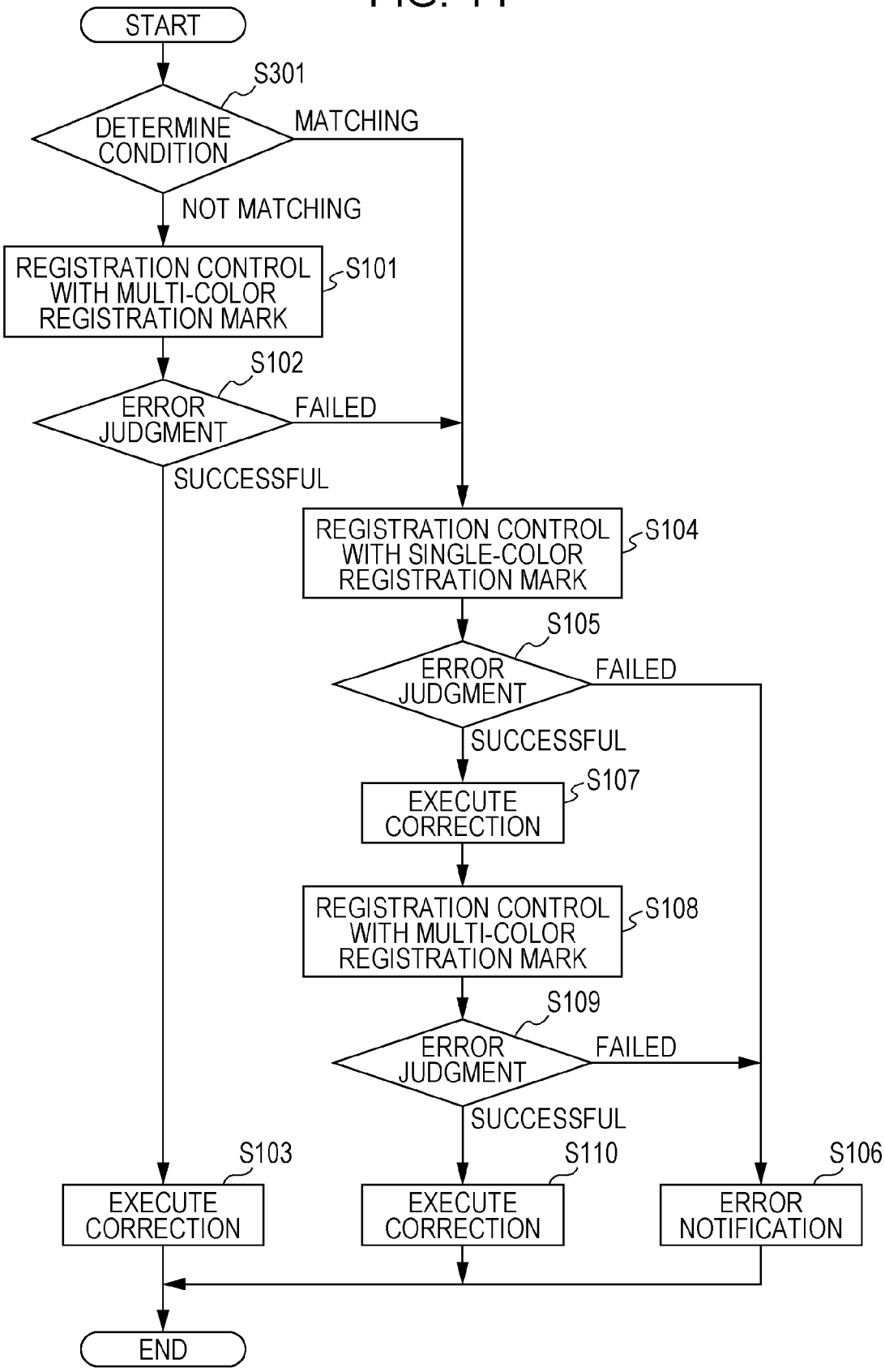
FIG. 14 is a flowchart describing processing of generating adjustment values used for registration processing according to a third exemplary embodiment.

FIG. 14 is a flowchart describing processing of generating adjustment values used for registration processing according to the third exemplary embodiment.

In the flowchart of FIG. 14, part of the processing is equivalent to part of the processing in the flowchart of FIG. 9 describing the processing of generating the adjustment values used for the registration processing according to the first exemplary embodiment. In FIG. 14, the same reference signs as those in FIG. 9 are applied to such equivalent processing. In the following description, the equivalent processing is not redundantly described.

The processing described in the flowchart of FIG. 14 is started by the main controller 40, after any of the various phenomena such as image formation by a predetermined number of sheets occurs, if the adjustment-value generation request flag is set at a timing at which processing such as a print operation is ended.

When the processing is started, the main controller 40 first determines whether or not any of the following first to third conditions is matching (step S301).

The first condition is a condition that the current number of times the power is turned on to the copier 1 (see FIGS. 1 and 2) is 1.

In the copier 1, the number of power-on times is stored on the memory 40*a* of the main controller 40. The number of power-on times stored on the memory 40*a* is incremented by 1 every time when the power is turned on. Also, when the copier 1 is shipped from the factory, "0" is stored on the memory 40*a* as the number of power-on times. That is, the first condition represents that the copier 1 is currently in a state in which the power is turned on for the first time since the copier 1 is shipped from the factory.

The second condition is a condition that any of the current image forming units 50Y, 50M, 50C, and 50K for YMCK colors is replaced with new one since the adjustment values for the previous registration processing are generated.

In the copier 1, the number of replacement times is stored on the memory 40*a* of the main controller 40 for each of the image forming units 50Y, 50M, 50C, and 50K for the respective colors. The numbers of replacement times for the image forming units stored on the memory 40*a* each are incremented by 1 every time when any of the image forming units is replaced. Also, every time when the adjustment values for the registration processing are generated, the numbers of replacement times of the image forming units 50Y, 50M, 50C, and 50K for the respective colors at the time of the generation of the adjustment values are duplicated in another region in the memory 40*a*.

More specifically, the second condition is a condition that the current numbers of replacement times of the image forming units 50Y, 50M, 50C, and 50K for the respective colors stored on the memory 40*a* include a number that differs from the corresponding number included in the numbers of replacement times in the another region. The main controller 40 determines that such an image forming unit is a unit replaced with new one since the adjustment values for the previous registration processing are generated.

The third condition is a condition that the current in-apparatus temperature of the copier 1 (see FIGS. 1 and 2) exceeds a predetermined temperature.

In the copier 1, a temperature sensor (not shown) measures the in-apparatus temperature.

If the in-apparatus temperature becomes a certain high temperature, the toner-image formation positions of the image forming units 50Y, 50M, 50C, and 50K for the respective colors may vary. Also, the variation may increase when the in-apparatus temperature increases.

In the third exemplary embodiment, in the above-described multi-color registration mark 100, the in-apparatus temperature, which has the least possibility to cause the variation to be generated by degree that causes the inner pattern to protrude from the outer pattern, is measured. The measured in-apparatus temperature is stored on the memory 40*a* of the main controller 40 as the predetermined temperature of the third condition.

If none of the above-described three conditions is matching, the copier 1 is in the following expected accuracy state.

The expected accuracy state is a predetermined apparatus state with a high possibility of being judged such that the multi-color registration mark 100 is a normal mark if it is assumed that the copier 1 forms the multi-color registration mark 100.

In the third exemplary embodiment, when the processing of generating the adjustment values for the registration processing is started, the main controller 40 first determines whether or not the copier 1 is in the expected accuracy state in step S301. The function of the main controller 40 for executing the processing in step S301 corresponds to an example of an apparatus-state determiner.

In the third exemplary embodiment, the above-described three conditions are exemplified as the conditions serving as the basis of the determination whether or not the state is the expected accuracy state. However, the determination whether or not the state is the expected accuracy state may be made based on any one or two of the three conditions. Alternatively, the determination whether or not the state is the expected accuracy state may be made based on conditions other than the above-described three conditions. For example such conditions may include a condition that an in-apparatus humidity exceeds a predetermined humidity, and a condition that an elapsed time since the previous adjustment values are acquired exceeds a predetermined time. Still alternatively, the determination whether or not the state is the expected accuracy state may be made based on four or more conditions by adding another condition relating to the in-apparatus humidity and/or the elapsed time to the above-described three conditions.

If it is determined that the copier 1 is in the expected accuracy state (not matching in step S301), the main controller 40 executes processing equivalent to the processing in step S101 to step S103 in the flowchart of FIG. 9. That is, in this case, the main controller 40 executes the generation of the adjustment values based on the formation of the multi-color registration mark 100.

In contrast, if any of the three conditions is matching, i.e., if the copier 1 is not in the expected accuracy state (matching in step S301), the main controller 40 omits the generation of the adjustment values based on the formation of the multi-color registration mark 100. Consequently, in the third exemplary embodiment, waste toner consumption is restricted as compared with a case in which the generation of the adjustment values based on the formation of the multi-color registration mark 100 is always executed.

Also, in this case, the main controller 40 executes processing equivalent to the processing from step S104 to step S110 in the flowchart of FIG. 9.

In particular, in this case, the main controller 40 executes the generation of the adjustment values based on the formation of the single-color registration mark 200 first, and then executes the generation of the adjustment values based on the multi-color registration mark 100.

In the third exemplary embodiment, the single-color registration mark 200 is formed in the processing corresponding to step S104 in the flowchart of FIG. 9. Alternatively, the processing may be processing of forming the thin-line multi-color registration mark 300 shown in FIG. 12.

In any of the first to third exemplary embodiments, the toners of four YMCK colors are exemplified as toners of plural colors. However, the toners with plural colors may be toners of five or more colors by adding a toner of another color to the toners of the four colors.

In any of the first to third exemplary embodiments, the color copier 1 is exemplified as the image forming apparatus. Alternatively, the image forming apparatus may be, for example, a color printer or a color facsimile.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a plurality of toner-image forming units that respectively use toners of a plurality of colors and form a plurality of toner images of different colors;

a transferred member that moves along the plurality of toner-image forming units and receives transfer of the plurality of toner images formed by the plurality of toner-image forming units;

a transfer member that further transfers the toner images of the plurality of colors transferred on the transferred member, on a recording medium;

a fixing unit that fixes the toner images of the plurality of colors transferred on the recording medium, to the recording medium;

a mark formation controller that causes the plurality of toner-image forming units to form a registration mark including a set of toner patterns for detection of shifts of toner-image formation positions of the plurality of toner-image forming units, on the transferred member;

a mark sensor that detects positions of the toner patterns included in the registration mark formed on the transferred member;

a formation-position shift calculator that calculates the shifts of the toner-image formation positions of the plurality of toner-image forming units based on the detection result of the mark sensor;

a mark judging unit that judges whether or not the registration mark detected by the mark sensor is a normal mark having accuracy enough for the calculation of the shifts of the toner-image formation positions of the plurality of toner-image forming units, based on the detection result of the mark sensor;

a formation-position adjuster that adjusts the toner-image formation positions of the plurality of toner-image forming units based on the calculation result of the formation-position shift calculator; and an adjustment sequence controller, wherein the adjustment sequence controller causes a first adjustment process to be executed by forming a second registration mark from among a first registration mark and the second registration mark, judging whether or not the second registration mark is a normal mark based on the detection result for the second registration mark, calculating the shifts of the toner-image formation positions based on the detection result for the second registration mark if it is judged that the second registration mark is the normal mark, and adjusting the toner-image formation positions based on the calculation result, the first registration mark including a set of first toner patterns, the second registration mark including a set of toner patterns having a second toner pattern, the second toner pattern being a toner pattern for detection of a shift of a toner-image formation position of at least one toner-image forming unit, the second toner pattern being formed by combining a first toner used by the at least one toner-image forming unit and a second toner used by another toner-image forming unit other than the at least one toner-image forming unit to reduce a calculation error of the shifts of the toner-image formation positions with the second toner pattern as compared with a calculation error with the first toner patterns, wherein the adjustment sequence controller causes a second adjustment process to be executed by forming the first registration mark if it is judged that the second registration mark is not the normal mark, judging whether or not the first registration mark is a normal mark based on the detection result for the first registration mark, calculating the shifts of the toner-image formation positions based on the detection result for the first registration mark if it is judged that the first registration mark is the normal mark, and adjusting the toner-image formation positions based on the calculation result, and wherein the adjustment sequence controller then causes a third adjustment process to be executed by forming the second registration mark, judging whether or not the second registration mark is the normal mark based on the detection result for the second registration mark, calculating the shifts of the toner-image formation positions based on the detection result for the second registration mark if it is judged that the second registration mark is the normal mark, and adjusting the toner-image formation positions based on the calculation result.

2. The image forming apparatus according to claim 1, further comprising:

an apparatus-state judging unit that judges whether or not the image forming apparatus is in a predetermined expected accuracy state expected to have a high possibility of being judged such that the second registration mark is the normal mark if it is assumed that the second registration mark is formed, wherein the adjustment sequence controller causes the apparatus-state judging unit to judge whether or not the image forming apparatus is in the expected accuracy state before the adjustment sequence controller causes the first adjustment process to be executed, and if it is judged that the image forming apparatus is not in the expected accuracy state, the adjustment sequence controller causes the execution of the first adjustment process to be omitted and causes the second adjustment process and the third adjustment process to be executed.

3. The image forming apparatus according to claim 1, wherein the toner-image forming units form, as the first registration mark, a first registration mark including the first toner patterns having a toner pattern for the detection of the shift of the toner-image formation position of the at least one toner-image forming unit, the toner pattern being formed by combining the first toner used by the at least one toner-image forming unit and the second toner used by another toner-image forming unit other that the at least one toner-image forming unit while it is permitted that a calculation error with the toner pattern increases as compared with the calculation error with the second toner pattern, and wherein the mark judging unit judges whether or not the registration mark is the normal mark by generating at least one of values of a line width and a shift amount from a reference position of the toner patterns included in the registration mark based on the detection result of the mark sensor, acquiring a count value of the number of the toner patterns based on the detection result, and judging whether or not both the at least one value and the count value are normal values.

4. The image forming apparatus according to claim 3, wherein, when the shift amount from the reference position of the toner patterns is acquired based on the detection result of the mark sensor, the mark judging unit judges whether or not the registration mark is the normal mark by comparing a first judgment reference for judging whether or not the first registration mark is the normal mark and a second judgment reference for judging whether or not the second registration mark is the normal mark with each other, and using one of the first and second judgment references with a relatively high possibility of being judged as the normal mark.

5. The image forming apparatus according to claim 1, wherein the toner-image forming units form, as the first registration mark, a first registration mark including a set of toner patterns for the detection of the shifts of the toner-image formation positions of the toner-image forming units, the toner patterns being respectively formed with only toners used by the toner-image forming units, and wherein, for the first registration mark, the mark judging unit judges whether or not the first registration mark is the normal mark by acquiring a count value of the number of the toner patterns based on the detection result of the mark sensor and judging whether or not the count value is a normal value, and for the second registration mark, the mark judging unit judges whether or not the second registration mark is the normal mark by generating at least one of values of a line width and a shift amount from a reference position of the toner patterns included in the second registration mark based on the detection result of the mark sensor, acquiring a count value of the number of the toner patterns, and judging whether or not both the at least one value and the count value are normal values.

* * * * *